US011124854B2

(12) United States Patent
Fujimura et al.

(10) Patent No.: US 11,124,854 B2
(45) Date of Patent: Sep. 21, 2021

(54) NON-ORIENTED ELECTRICAL STEEL SHEET AND METHOD FOR MANUFACTURING NON-ORIENTED ELECTRICAL STEEL SHEET

(71) Applicant: NIPPON STEEL CORPORATION, Tokyo (JP)

(72) Inventors: Hiroshi Fujimura, Tokyo (JP); Takeru Ichie, Tokyo (JP); Yoshiaki Natori, Tokyo (JP); Hiroyoshi Yashiki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 212 days.

(21) Appl. No.: 16/487,020

(22) PCT Filed: Mar. 7, 2018

(86) PCT No.: PCT/JP2018/008780
§ 371 (c)(1),
(2) Date: Aug. 19, 2019

(87) PCT Pub. No.: WO2018/164185
PCT Pub. Date: Sep. 13, 2018

(65) Prior Publication Data

US 2020/0232059 A1 Jul. 23, 2020

(30) Foreign Application Priority Data

Mar. 7, 2017 (JP) ..... JP2017-042547

(51) Int. Cl.

| | |
|---|---|
| ***C21D 9/46*** | (2006.01) |
| ***C22C 38/34*** | (2006.01) |
| ***C22C 38/16*** | (2006.01) |
| ***C22C 38/08*** | (2006.01) |
| ***C22C 38/06*** | (2006.01) |
| ***C22C 38/04*** | (2006.01) |
| ***C22C 38/00*** | (2006.01) |
| ***C21D 8/12*** | (2006.01) |
| ***C21D 8/00*** | (2006.01) |
| ***C21D 6/00*** | (2006.01) |
| ***H01F 1/147*** | (2006.01) |

(52) U.S. Cl.

CPC ..... *C21D 9/46* (2013.01); *C21D 6/001* (2013.01); *C21D 6/002* (2013.01); *C21D 6/005* (2013.01); *C21D 6/008* (2013.01); *C21D 8/005* (2013.01); *C21D 8/1222* (2013.01); *C22C 38/001* (2013.01); *C22C 38/002* (2013.01); *C22C 38/005* (2013.01); *C22C 38/008* (2013.01); *C22C 38/04* (2013.01); *C22C 38/06* (2013.01); *C22C 38/08* (2013.01); *C22C 38/16* (2013.01); *C22C 38/34* (2013.01); *H01F 1/14775* (2013.01); *C22C 2202/02* (2013.01)

(58) Field of Classification Search

CPC .... C21D 2201/05; C21D 6/001; C21D 6/002; C21D 6/005; C21D 6/008; C21D 8/005; C21D 8/12; C21D 8/1222; C21D 8/1233; C21D 8/1261; C21D 8/1272; C21D 9/46; C22C 2202/02; C22C 38/001; C22C 38/002; C22C 38/004; C22C 38/005; C22C 38/008; C22C 38/02; C22C 38/04; C22C 38/06; C22C 38/08; C22C 38/16; C22C 38/34; C22C 38/38; C22C 38/60; H01F 1/147; H01F 1/14775; H01F 1/16

See application file for complete search history.

(56) References Cited

U.S. PATENT DOCUMENTS

| | | | |
|---|---|---|---|
| 2011/0273054 | A1 | 11/2011 | Johnston |
| 2013/0263976 | A1 | 10/2013 | Omura et al. |
| 2014/0332119 | A1 | 11/2014 | Takashima et al. |
| 2014/0366988 | A1 | 12/2014 | Dominger et al. |
| 2015/0027590 | A1 | 1/2015 | Nakanishi et al. |
| 2017/0260600 | A1 | 9/2017 | Okubo et al. |
| 2018/0030558 | A1 | 2/2018 | Okubo et al. |
| 2018/0066333 | A1 | 3/2018 | Nakajima et al. |
| 2018/0119258 | A1 | 5/2018 | Fujikura et al. |

FOREIGN PATENT DOCUMENTS

| | | | |
|---|---|---|---|
| CN | 101310034 | A | 11/2008 |
| JP | 60-238421 | A | 11/1985 |
| JP | 62-112723 | A | 5/1987 |
| JP | 2-8346 | A | 1/1990 |
| JP | 2-22442 | A | 1/1990 |

(Continued)

OTHER PUBLICATIONS

International Search Report, issued in PCT/JP2018/008780, dated Jun. 5, 2018.

(Continued)

*Primary Examiner* — Jenny R Wu

(74) *Attorney, Agent, or Firm* — Birch, Stewart, Kolasch & Birch, LLP

(57) ABSTRACT

This non-oriented electrical steel sheet including, as a chemical composition, by mass %: C: 0.0100% or less; Si: more than 3.0% and 5.0% or less; Mn: 0.1 to 3.0%; P: 0.20% or less: S: 0.0018% or less: N: 0.0040% or less; Al: 0 to 0.9%; one or more selected from the group consisting of Sn and Sb: 0 to 0.100%; Cr 0 to 5.0%; Ni: 0 to 5.0%; Cu: 0 to 5.0%; Ca: 0 to 0.01%; rare earth elements (REM): 0 to 0.010%; and a remainder including Fe and impurities, in which an area ratio of a crystal structure A composed of crystal grains having a grain size of 100 μm or greater in a cross section parallel to a rolled surface of the non-oriented electrical steel sheet is 1 to 30%, an average grain size of a crystal structure B that is a crystal structure other than the crystal structure A is 25 μm or less, and a Vickers hardness HvA of the crystal structure A and a Vickers hardness HvB of the crystal structure B satisfy HvA/HvB≤1.000.

3 Claims, No Drawings

(56) References Cited

FOREIGN PATENT DOCUMENTS

| | | | |
|---|---|---|---|
| JP | 8-134606 | A | 5/1996 |
| JP | 9-125148 | A | 5/1997 |
| JP | 2005-113185 | A | 4/2005 |
| JP | 2005-120403 | A | 5/2005 |
| JP | 2007-186790 | A | 7/2007 |
| JP | 2007-247047 | A | 9/2007 |
| JP | 2008-50686 | A | 3/2008 |
| JP | 2010-90474 | A | 4/2010 |
| JP | 2010-121150 | A | 6/2010 |
| JP | 2010-259158 | A | 11/2010 |
| JP | 2011-6721 | A | 1/2011 |
| JP | 2012-149337 | A | 8/2012 |
| TW | I448566 | B | 8/2014 |
| TW | I499676 | B | 9/2015 |
| WO | WO 2013/125223 | A1 | 8/2013 |
| WO | WO 2016/017263 | A1 | 2/2016 |
| WO | WO 2016/132753 | A1 | 8/2016 |
| WO | WO 2016/136095 | A1 | 9/2016 |
| WO | WO 2016/175121 | A1 | 11/2016 |

OTHER PUBLICATIONS

JIS C 2550, 2011, total 477 pages including translation.
JIS Z 2241, "Metallic materials—Tensile Testing—Method of test at room temperature", 2011, pp. 477-548, total 37 pages.
JIS Z 2244, "Vickers hardness test—Test method", 2009, pp. 394-497, total 99 pages including translation.
Taiwanese Office Action, issued in Application No. 107107710, dated Oct. 24, 2018.
Written Opinion of the International Searching Authority, issued in PCT/JP2018/008780, dated Jun. 5, 2018.

NON-ORIENTED ELECTRICAL STEEL SHEET AND METHOD FOR MANUFACTURING NON-ORIENTED ELECTRICAL STEEL SHEET

TECHNICAL FIELD OF THE INVENTION

The present invention relates to a non-oriented electrical steel sheet and a method for manufacturing the non-oriented electrical steel sheet.

Priority is claimed on Japanese Patent Application No. 2017-042547, filed Mar. 7, 2017, the content of which is incorporated herein by reference.

RELATED ART

In recent years motors (hereinafter referred to as high-speed rotation motors) that perform high-speed rotation are increasing. In high-speed rotation motors, a centrifugal force acting on a rotating body, such as a rotor, becomes large hence high strength is required for electrical steel sheets that are materials of the rotors of the high-speed rotation motors.

Additionally, in the high-speed rotation motors, an eddy current is generated due to high-frequency magnetic flux, motor efficiency degrades, and heat is generated. If the amount of heat generated increases, magnets within a rotor are demagnetized. For that reason, a low iron loss is required for the rotors of the high-speed rotation motors. Hence, not only high strength but also excellent magnetic characteristics are required for the electrical steel sheets that are the materials of the rotors.

The strength of the steel sheets becomes high due to solid solution strengthening, precipitation strengthening, grain refining, or the like. However, in a case where the steel sheets are made to have high strength by these strengthening mechanisms, there is a case where the magnetic characteristics may degrade. Hence, it is not easy to, make the high strength and the excellent magnetic characteristics compatible with each other in non-oriented electrical steel sheets.

Additionally, there is a case where additional heat treatment is performed on the non-oriented electrical steel sheets. For example, in a case where blanks for using stator cores for motors are cut out from the non-oriented electrical steel sheets a space is formed at a center portion of each blank. If portions cut out to form the spaces of the center portions are used as blanks for rotors, that is, if the blanks for a rotor and the blanks for a stator core are made from one non-oriented electrical steel sheet, this is preferable because the yield increases.

As described above, strength and low iron loss are particularly required of the blanks for rotors. On the other hand, the blanks for stator cores do not require high strength but require excellent magnetic characteristics (high magnetic flux density and low iron loss). For this reason, in a case where the blanks for rotors and the blanks for stator cores are made of one non-oriented electrical steel sheet, the blanks cut out for stators need to be subjected to additional heat treatment and be sufficiently recrystallized in order to remove strain resulting from the processing of the non-oriented electrical steel sheet made to have higher strength to enhance the magnetic characteristics after being molded into stator cores.

Hence, in the non-oriented electrical steel sheet from which the blanks for stator cores and the blanks for rotors are made, the high strength, and the excellent magnetic characteristics before and after the additional heat treatment are required.

Patent Documents 1 to 7 disclose non-oriented electrical steel sheets that achieve compatibility between high strength and excellent magnetic characteristics.

Patent Document 1 discloses a non-oriented electrical steel sheet containing one or two or more kinds of elements selected from the group consisting of Si: 3.5-7.0%. Ti: 0.05-3.0%, W: 0.05 to 8.0%, Mo: 0.05 to 3.0%, Mn: 0.1 to 11.5%, Ni: 0.1 to 20.0%, Co: 0.5 to 20.0%, and Al: 0.5 to 18.0%, in a range that does not exceed 20.0%. In Patent Document 1, the strength of the steel sheet is enhanced by enhancing the Si content and performing, solid solution strengthening by Ti, W, Mo, Mn, Ni and Co, and Al.

Patent Document 2 discloses a method for manufacturing a high-strength soft magnetic steel sheet in which a slab containing Si: 3.5 to 7.0% and containing one or more selected from the group consisting of the group consisting of W: 0.05 to 9.0%, Mo: 0.05 to 9.0%, Ti: 0.05 to 10.0%, Mn: 0.1 to 11.0%, Ni: 0.1 to 20.0%, Co: 0.5 to 20.0%, and Al: 0.5 to 13.0% is formed into a hot-rolled sheet by hot rolling, then the hot-rolled sheet is subjected to cold rolling to have a final sheet thickness of 0.01 to 0.35 mm, and subsequently the cold-rolled sheet is subjected to annealing in a temperature range of 800 to 1250° C. to have an average crystal grain size of 0.01 to 5.0 mm.

Patent Document 3 discloses a high-strength electrical steel sheet containing C: 0.01% or less, Si: 2.0% or more and less than 4.0%, Al: 2.0% or less, and P: 0.2% or less and containing one or more of Mn and Ni in a range of 0.3%≤Mn Ni<10%, the remainder including Fe and unavoidable impurities. In Patent Document 3, the strength of the steel sheet is enhanced by solid solution strengthening by Mn and Ni.

Patent Document 4 discloses a high-strength electrical steel sheet containing C: 0.04% or less, Si: 2.0% or more and less than 4.0%, Al: 2.0% or less, and P: 0.2% or less and containing one or more of Mn and Ni in a range of 0.3%≤Mn+Ni<10%, one or two or more kinds of elements of Nb and Zr being controlled to satisfy 0.1<(Nb+Zr)/8(C+N)<1.0, and the remainder including Fe and unavoidable impurities. In Patent Document 4, the strength of the steel sheet is enhanced by solid solution strengthening by Mn and Ni, and the compatibility between the high strength and the magnetic characteristics is achieved by using carbonitrides, including such as Nb and Zr.

Patent Document 5 discloses a high-strength electrical steel sheet containing, by mass %, C: 0.060% or less, Si: 0.2 to 3.5%, Mn: 0.05 to 3.0%, P: 0.30% or less, S: 0.040% or less, Al: 2.50% or less and N: 0.020% or less, the remainder including Fe and unavoidable impurities, and a processed structure remaining inside a steel.

Patent Document 6 discloses a high-strength non-oriented electrical steel sheet containing, by mass %, C and N limited so as to be C: 0.010% or less and N: 0.010% or less and C+N≤0.010%, and containing Si: 1.5% or more and 5.0% or less, Mn: 3.0% or less, Al: 3.0% or less, P: 0.2% or less S: 0.01% or less, and Ti: 0.05% or more and 0.8% or less so as to be Ti/(C+N)≥16, the remainder having chemical composition of Fe and unavoidable impurities, and a ratio of a non-recrystallized recovered, structure in the steel sheet being 50% or more in area ratio.

Patent Document 7 discloses a non-oriented electrical steel sheet containing, by mass %, C: 0.010% or less, Si: more than 3.5% and 5.0% or less, Al: 0.5% or less. P: 0.20% or less, S: 0.002% or more and 0.005% or less, and N: 0.010% or less and containing Mn in a range that satisfies $(5.94\times10^{-5})/S\ \%)\leq Mn\leq(4.47\times10^{-4})/(S\ \%)$ in a relationship with 5 content (mass %), the remainder having chemical composition of Fe and unavoidable impurities, the area ratio of recrystallized grains in a steel sheet rolling-direction cross section (ND-RD cross section) being 30% or more and 90% or less, and the rolling-direction length of a coupled non-recrystallized gram group being 1.5 mm or less.

As being represented by the above-described Patent Documents 1 to 7, non-oriented electrical steel sheets for the purpose of achieving the compatibility between the high strength and the excellent magnetic characteristics have been developed.

However, in the non-oriented electrical steel sheets disclosed in Patent Documents 1 to 7, the characteristics after the additional heat treatment are not taken into consideration. As a result of studies by the present inventors, it can be seen that, in a case where the additional heat treatment is performed on the non-oriented electrical steel sheets disclosed in these documents, there is a case that the magnetic characteristics degrade.

Patent Document 8 discloses a non-oriented electrical steel sheet with high magnetic flux density after stress relief annealing, the steel sheet containing, by wt %, 7.00% or less of Si and 0.010% or less of C in steel and having a texture in which $I_{(100)}$ and $I_{(111)}$, which are values of the ratio of a portion with a depth of ⅕ of a sheet thickness from a surface layer of the steel sheet before the stress relief annealing with respect to a random texture with X rays reflecting surface strength in orientations (100) and (111) in a plane parallel to an imaginary plane, satisfies $0.50 \leq I_{(100)}/I_{(111)}$.

However, high-strengthening is not studied at all in Patent Document 8. Additionally, in Patent Document 8, the iron loss evaluated is $W_{15/50}$, and the high-speed rotation motors are not targeted. Additionally, it is also unclear whether or not high-frequency iron loss such as $W_{10/400}$ is excellent after the stress relief annealing. The influence of heat treatment on the magnetic characteristics varies in a steel sheet intended for high-strengthening and a steel sheet not intended for the high-strengthening. For that reason, Patent Document 8 does not suggest improvements in magnetic characteristics after the heat treatment in the high-strength non-oriented electrical steel sheets.

As described above, in the related art, non-oriented electrical steel sheets having the high strength and the excellent magnetic characteristics before and after the additional heat treatment are not disclosed.

PRIOR ART DOCUMENT

Patent Document

[Patent Document 1] Japanese Unexamined Patent Application, First Publication No. 560-238421

[Patent Document 2] Japanese Unexamined Patent Application, First Publication No. 862-112723

[Patent Document 3] Japanese Unexamined Patent Application, First Publication No. H2-22442

[Patent Document 4] Japanese Unexamined Patent Application, First Publication No. H2-8346

[Patent Document 5] Japanese Unexamined Patent Application, First Publication No. 2005-113185

[Patent Document 6] Japanese Unexamined Patent Application, First Publication No. 2007-186790

[Patent Document 7] Japanese Unexamined Patent Application, First Publication No. 2010-090474

[Patent Document 8] Japanese Unexamined Patent Application, First Publication No. 118-134606

DISCLOSURE OF THE INVENTION

Problems to be Solved by the Invention

The invention has been made in view of the above problems. An object of the invention is to provide a non-oriented electrical steel sheet having high strength and having excellent magnetic characteristics even after additional heat treatment, and a method for manufacturing the non-oriented electrical steel sheet.

Means for Solving the Problem (1) A non-oriented electrical steel sheet according to an aspect of the invention including, as a chemical composition, by mass %: C: 0.0100% or less; Si: more than 3.0% and 5.0% or less; Mn: 0.1 to 3.0%; P: 0.20% or less; S: 0.0018% or less; N: 0.0040% or less; Al: 0 to 0.9%; one or more selected from the group consisting of Sn and Sb: 0 to 0.100%; Cr: 0 to 5.0%; Ni: 0 to 5.0%; Cu: 0 to 5.0%; Ca: 0 to 0.01%; rare earth elements (REM): 0 to 0.010%; and a remainder including Fe and impurities, in which an area ratio of a crystal structure A composed of crystal grains having a grain size of 100 μm or greater in a cross section parallel to a rolled surface of the non-oriented electrical steel sheet is 1 to 30%, an average grain size of a crystal structure B that is a crystal structure other than the crystal structure A is 25 μm or less, and a Vickers hardness HvA of the crystal, structure A and a Vickers hardness HvB of the crystal structure B satisfy Expression (a).

$$HvA/HvB \leq 1.000 \quad (a)$$

(2) In the non-oriented electrical steel sheet according to the above (1), the chemical composition may contain one or more selected from the group consisting of the group consisting of Al: 0.0001 to 0.9%; one or more selected from the group consisting of Sn and Sb: 0.005 to 0.100%; Cr: 0.5 to 5.0%; Ni: 0.05 to 5.0%; Cu: 0.5 to 5.0%; Ca: 0.0010 to 0.0100%; and rare earth elements (REM): 0.0020 to 0.0100% or less.

(3) A method for manufacturing the non-oriented electrical steel sheet according to another aspect of the invention is a method for manufacturing the non-oriented electrical steel sheet described in (1) including performing a hot rolling to manufacture a hot-rolled steel sheet after a slab having the chemical composition according to claim 1 is heated at 1000 to 1200° C.; performing a hot-rolled sheet annealing with an average heating speed at 750 to 850° C. being 50° C./sec or higher and a maximum attainment temperature being 900 to 1150° C., on the hot-rolled steel sheet; performing a cold rolling or warm rolling at a rolling reduction of 83% or more on the hot-rolled steel sheet after the hot-rolled sheet annealing, to manufacture an intermediate steel sheet; and performing a final annealing with a maximum attainment temperature being 700 to 800° C. and an average cooling rate in a temperature range of 700 to 500° C. being 50° C./sec or higher, on the intermediate steel sheet.

Effects of the Invention

According to the above aspects of the invention, the non-oriented electrical steel sheet having high strength and having excellent magnetic characteristics even after additional heat treatment, and the method for manufacturing the non-oriented electrical steel sheet are obtained.

EMBODIMENTS OF THE INVENTION

The present inventors have investigated the strength and the magnetic characteristics of a high-strength non-oriented electrical steel sheet in order to solve the above problems.

First, two slabs a slab containing, by mass %, C: 0.0012%, Si: 3.3%, Mn: 0.4%, Al: 0.3%, P: 0.02%, and N: 0.0016% and further containing S: 0.0021%, and a slab in which C, Si. Mn, Al, P, and N contents are the same as the above and the S content is 0.0011% were prepared. After the two slabs were heated at 1150° C., hot rolling was performed, and hot-rolled steel sheets having a sheet thickness of 2.0 mm were manufactured. Hot-rolled sheet annealing was performed on these hot-rolled steel sheets. The maximum attainment temperature of the hot-rolled sheet annealing was 1050° C., and the average heating speed in a temperature range of 750 to 850° C. was set to the following two conditions.

Heating speed condition 1: 30° C./sec, and

Heating speed condition 2: 60° C./sec

Pickling was performed on the hot-rolled steel sheets after the hot-rolled sheet annealing. Thereafter, cold rolling was performed on the hot-rolled steel sheets, and cold-rolled steel sheets having a sheet thickness of 0.35 mm were manufactured. Final annealing was performed on the cold-rolled steel sheets at a maximum attainment temperature of 770° C., and non-oriented electrical steel sheets were manufactured. In this case, the average cooling rate at 700 to 500° C. after the final annealing was set to the following two conditions.

Cooling rate condition 1: 30° C./sec, and

Cooling rate condition 2: 60° C./sec

Tensile strength and magnetic characteristics (magnetic flux density and iron loss) were measured on the manufactured non-oriented electrical steel sheets, supposing blanks for rotors.

Moreover, supposing blanks for stator cores, samples were collected from the non-oriented electrical steel sheets, additional heat treatment was performed at 800° C. for 2 hours in a nitrogen atmosphere, and crystal structures in which structures of the samples have sufficiently grown to grains were obtained. The magnetic characteristics (magnetic flux density and iron loss) were measured on the samples having the crystal structures that have sufficiently grown to grains.

As a result of the measurement, in any S contents and under any conditions (the heating speed condition 1, the heating speed condition 2, the cooling rate condition 1, the cooling rate condition 2), the non-oriented electrical steel sheets had a tensile strength of 600 MPa or more, and had higher strength than non-oriented electrical steel sheets in the related art (for example, a steel sheet that is generally applied to 50A230 of JISC2550). Additionally, the magnetic characteristics were the same as those of the non-oriented electrical steel sheets in the related art.

Hence, the non-oriented electrical steel sheets manufactured under any conditions also had the characteristics suitable for the blanks for rotors.

Meanwhile, the magnetic characteristics of a non-oriented electrical steel sheet after the additional heat treatment, in which the S content was low, the heating speed was increased in the hot-rolled sheet annealing (heating speed condition 2: 60° C./sec), and the cooling rate was increased in the final annealing (cooling rate condition 2: 60° C./sec), were highest. In contrast, the magnetic characteristics, especially the magnetic flux density of a non-oriented electrical steel sheet after the additional heat treatment, in which the S content was high and the heating speed was slow (heating speed condition 1: 30° C./sec) or the cooling rate was slow in the final annealing (cooling rate condition 1: 30° C./sec), were low.

That is, only in a case where an S content was low and the heating speed in the hot-rolled sheet annealing and the cooling rate after the final annealing were fast, characteristics suitable for both the blanks for rotors and the blanks for stator cores were obtained.

The present inventors performed embedding, polishing, and structure observation on ¼ thickness cross sections (cross sections including ¼ depth positions (t/4 positions when the thicknesses of the non-oriented electrical steel sheets are defined as t (unit is mm) of sheet thicknesses from the rolled surfaces in cross sections orthogonal to a rolling direction of the steel sheets)) parallel to the rolled surfaces of the non-oriented electrical steel sheets before the additional heat treatment, which is manufactured under the respective conditions. As a result, in any non-oriented electrical steel sheets, a microstructure was a mixed structure including a crystal structure A that is a region of crystal grains having a gram size of 100 μm or more, and a crystal structure B having a grain size of each crystal grain of less than 100 μm and an average grain size of 25 μm or less.

As described above, in the non-oriented electrical steel sheets manufactured under any conditions, differences between the structures observed with an optical microscope were small. For that reason, the non-oriented electrical steel sheets are considered to have the substantially the same strength and magnetic characteristics as before the additional heat treatment.

Meanwhile, as described above, in a case where the above-described non-oriented electrical steel sheets manufactured under the respective conditions were subjected to the additional heat treatment, a clear difference occurred in the magnetic flux density after the additional heat treatment. It is considered that this arises from a material change, in which structures included in the crystal structure A before the additional heat, treatment has grown due to heat treatment and crystal orientations in the respective non-oriented electrical steel sheets becomes different states for each. That is, it is considered that a difference occurred in the crystal orientations that develop during the additional heat treatment depending on the S contents or manufacturing conditions. The present inventors considered that the reason that the difference occurred in the crystal orientations that develop during the additional heat treatment is a difference in a fine structure (dislocation structure) within the crystal structure A that cannot be distinguished with an optical, microscope.

Thus, the present inventors observed the non-oriented electrical steel sheets manufactured under the respective conditions with an electron microscope and X rays. As a result, in the non-oriented electrical steel sheet in which the S content was low, the heating speed was increased (60° C./sec) in the hot-rolled sheet annealing, and the cooling rate was increased (60° C./sec) in the final annealing, the area ratio of the crystal structure A was 1 to 30%, and the Vickers hardness HvA of the crystal structure A was equal to or less than the Vickers hardness HvB of the crystal structure B. In contrast, in any non-oriented electrical steel sheets manufactured under the other conditions, the Vickers hardness HvA of the crystal structure A was larger than the Vickers hardness HvB of the crystal structure B.

On the basis of the above results, the present inventors considered that the hardness ratio HvA/HvB influenced improvements in the magnetic characteristics by the subsequent additional heat treatment. Thus, the study was further performed, suitable strength was obtained before the additional heat treatment, and structures where excellent magnetic characteristics were obtained when grain growth was proceeded by the additional heat treatment, were identified.

A non-oriented electrical steel sheet of the invention completed on the basis of the above knowledge contains, as a chemical composition, by mass %: C: 0.0100% or less; Si: more than 3.0% and 5.0% or less; Mn: 0.1 to 3.0%; P: 0.20% or less; S: 0.0018% or less; and N: 0.0040% or less, and if necessary, containing Al: 0.9% or less; one or more selected from the group consisting of Sn and Sb: 0.100% or less; Cr: 5.0% or less; Ni: 5.0% or less; and one or more selected from the group consisting of the group consisting of Cu: 5.0% or less; Ca: 0.010% or less; and rare earth elements (REM): 0.010% or less, the remainder including Fe and impurities, an area ratio of a crystal structure A composed of crystal grains having a grain size of 100 μm or greater in a cross section parallel to a rolled surface of the non-oriented electrical steel sheet is 1 to 30%, an average grain size of a crystal structure B that is a crystal structure other than the crystal structure A is 25 μm or less, and a Vickers hardness HvA of the crystal structure A and a Vickers hardness HvB of the crystal structure B satisfy Expression (1).

$$HvA/HvB \leq 1.000 \quad (1)$$

Additionally, a method for manufacturing the non-oriented electrical steel sheet of the invention includes performing hot rolling to manufacture a hot-rolled steel sheet after a slab having the chemical composition is heated at 1000 to 1200° C.; performing hot-rolled sheet annealing with an average heating speed at 750 to 850° C. being 50° C./sec or higher and a maximum attainment temperature being 900 to 1150° C., on the hot-rolled steel sheet; performing cold rolling or warm rolling at a rolling reduction of 83% or more on the hot-rolled steel sheet after the hot-rolled sheet annealing, to manufacture an intermediate steel sheet; and performing final annealing with a maximum attainment temperature being 700 to 800° C. and an average cooling rate in a temperature range of 700 to 500° C. being 50° C./sec or higher, on the intermediate steel sheet.

Hereinafter, the non-oriented electrical steel sheet (the non-oriented electrical steel sheet according to the present embodiment) according to an embodiment of the invention and the method for manufacturing a non-oriented electrical steel sheet according to the present embodiment, will be described in detail.

[Non-Oriented Electrical Steel Sheet]

The chemical composition of the non-oriented electrical steel sheet according to the present embodiment contains the following elements. Hereinafter, % regarding then elements means "mass %".

C: 0.0100% or less

Carbon (C) has the effect of enhancing strength by precipitation of carbides. However in the non-oriented electrical steel sheet according to the present embodiment, high-strengthening is mainly achieved by solid solution strengthening of substitutional elements, such as Si, and control f the ratio of the crystal structure A and the crystal structure B. Hence, C may not be contained for the high-strengthening. That is, the lower limit of C content includes 0%. However, since C is usually contained inevitably, the lower limit may be set to more than 0%.

On the other hand, if the C content is too high, the magnetic characteristics of the non-oriented electrical steel sheet degrade. Additionally, the workability of the non-oriented electrical steel sheet according to the present embodiment that is high Si steel degrades. Hence, the C content is 0.0100% or less. The C content is preferably 0.0050% or less and more preferably 0.0030% or less.

Si: More than 3.0% and 5.0% or less

Silicon (Si) has the effect of deoxidizing steel. Additionally, Si enhances the electric resistance of steel and reduces (improve) the iron loss of the non-oriented electrical steel sheet. Si also has higher solid solution strengthening performance as compared to other solid solution strengthening elements, such as Mn, Al, and Ni, which are contained in the non-oriented electrical steel sheet. For that reason, Si is most effective in order to make the high-strengthening and iron loss decrease compatible with each other in a balanced manner. The above effect is not obtained if the Si content is 3.0% or less. For that reason, the Si content is set to more than 3.0%.

On the other hand, if the Si content is too high, manufacturability, especially the bending workability of the hot-rolled steel sheet degrades. Additionally, as will be described below, the degradation of the bending workability can be limited by appropriately controlling the grain size of the hot-rolled steel sheet. However, if the Si content exceeds 5.0%, cold workability degrades. Hence, the Si content is 5.0% or less. Preferably, the Si content is 4.5% or less.

Mn: 0.1 to 3.0%

Manganese (Mn) enhances the electric resistance of steel and reduces the iron loss. The above effect is not obtained if the Mn content is less than 0.1%. Additionally, if the Mn content is less than 0.1%, Mn sulfides are finely generated. The fine Mn sulfides inhibit domain wall displacement, or inhibit the crystal grain growth during a manufacturing step. In this case, the magnetic flux density decreases. For that reason, the Mn content is set to 0.1% or more. The Mn content is preferably 0.15% or more and more preferably 0.4%.

On the other hand, if the Mn content exceeds 3.0%, austenite transformation is likely to occur, and the magnetic flux density decreases, Hence, the Mn content is 3.0% or less. The Mn content is preferably 2.5% or less and more preferably 2.0% or less.

P: 0.20% or less

Phosphorus (P) enhances the strength of steel by the solid solution strengthening. However, if the P content is too high, P segregates and the steel embrittles. Hence, the P content is 0.20% or less. The P content is preferably 0.10% or less and more preferably 0.07% or less.

S: 0.0018% or less

Sulfur (S) is an impurity. S forms sulfides, such as MnS. The sulfides inhibit the domain wall displacement, and inhibit the crystal grain growth and degrade the magnetic characteristics. Hence, it is preferable that the S content is as low as possible. Particularly, if the S content exceeds 0.0018%, the magnetic characteristics degrade significantly. Hence, the S content is 0.0018% or less. The S content is preferably 0.0013% or less and more preferably 0.0008% or less.

Meanwhile, if production of MnS is appropriately controlled by controlling the Mn content and the S content, and the manufacturing conditions described below, S is also an element that contributes to formation of the dislocation structure in the crystal structure A that are effective in order to avoid the degradation of the magnetic characteristics after the additional heat treatment. In a case where this effect is obtained, it is preferable that the S content is 0.0001% or more.

N: 0.0040% or less

Nitrogen (N) is an impurity. N degrades the magnetic characteristics after the additional heat treatment. Hence, the N content is 0.0040% or less. The N content is preferably 0.0020% or less.

The chemical composition of the non-oriented electrical steel sheet according to the present embodiment is based on including the above-described elements, and Fe and the impurities that are the remainder. However, if necessary, instead of a portion of Fe, one or more of the optional elements (Al, Sn, Sb, Cr, Ni, Cu, Ca, and/or REM) may be further contained in the ranges shown below. Lower limits are 0% because these optional elements are not necessarily contained.

The impurities mean ones that are mixed from ore or scraps serving as a raw material or from manufacturing environment or the like when a non-oriented electrical steel sheet is industrially manufactured, impurities and that are allowed in a range where the impurities do not have a bad influence on the non-oriented electrical steel sheet according to the present embodiment.

[Regarding Optional Elements]

Al: 0 to 0.9%

Aluminum (Al) is an optional element and may not be contained. Al has the effect of deoxidizing steel, similarly to Si. Al also enhances the electric resistance of steel and reduces the iron loss. In a case where these effects are obtained, it is preferable that the Al content is 0.0001% or more.

However, as compared to Si, Al does not contribute to the high-strengthening of steel. Moreover, if the Al content is too high, the workability degrades. Hence, even in a case where Al is contained, the Al content is 0.9% or less. The Al content is preferably 0.7% or less.

One or more selected from the group consisting, of the group consisting of Sn and Sb: 0 to 0.100%

Both Tin (Sn) and antimony (Sb) are optional elements and may not be contained. Sn and Sb improve a texture of the non-oriented electrical steel sheet to enhance the magnetic characteristics (for example, by increasing the crystal grains in orientations that contribute to the improvements in magnetic characteristics). In a case where the above effect is stably and effectively obtained, it is preferable that the total amount of one or more of selected from the group consisting of the group consisting of Sn and Sb is 0.005% or more.

However, if the total amount of these elements exceeds 0.100%, steel embrittles. In this case, during manufacture, the steel sheet may break, or surface defects may be generated. Hence, even in a case where these elements are contained, the total amount of one, or more selected from the group consisting of the group consisting, of Sn and Sb is 0.100% or less.

Cr: 0 to 5.0%

Chromium (Cr) is an optional element and may not be contained. Cr enhances the electric resistance of steel. Particularly, if Cr is contained together with Si, compared to cases where Si and Cr are independently contained, respectively, the electric resistance of steel can be enhanced, and the iron loss can be reduced. Cr further enhances the manufacturability of high Si steel as in the non-oriented electrical steel sheet according to the present embodiment, and also enhances corrosion resistance. In a case where the above effect is stably and effectively obtained, it is preferable that the Cr content is 0.5% or more.

However, if the Cr content exceeds 5.0%, the effect is saturated, and cost becomes high. Hence, even in a case where Al is contained, the Cr content is 5.0% or less. The Cr content is preferably 1.0% or less.

Ni: 0 to 5.0%

Nickel (Ni) enhances the strength of steel by the solid solution strengthening without lowering saturation magnetic flux density and further enhances the electric resistance of the steel and reduces the iron loss. In a case where the above effect is stably and effectively obtained, it is preferable that the Ni content is 0.05% or more.

However, if the Ni content exceeds 5.0%, the cost becomes high. Hence, even in a case where Ni is contained, the Ni content is 5.0% or less. The Ni content is preferably 2.0% or less.

Cu: 0 to 5.0%

Copper (Cu) enhances the strength of steel by the solid solution strengthening. Additionally by performing ageing treatment at a temperature of about 500° C. Cu forms a fine Cu precipitation phase and strengthens steel. In a case the above effect is stably and effectively obtained, it is preferable that the Cu content is 0.5% or more.

However, if the Cu content exceeds 5.0%, Steel embrittles. Hence, even in a case where Cu is contained, the Cu content is 5.0% or less. The Cu content is preferably 2.0% or less.

Ca: 0 to 0.010%

Rare earth elements (REM): 0 to 0.010%

Calcium (Ca) and REM are combined with S in steel to fix S. Accordingly, the magnetic characteristics of steel are enhanced. In a case the above effect is stably and effectively obtained, it is preferable that the Ca content is 0.001% or more and the REM content is 0.002% or more.

On the other hand, if the Ca content and the REM content exceed 0.010%, respectively, the effect is saturated, and the cost becomes high. Hence, even in a case where Ca and REM are contained, the Ca content is 0.010% or less, and the REM content is 0.010% or less.

REM in the present embodiment means Sc, Y, and lanthanoids (La of Atomic number 57 to Lu of Atomic number 71), and the REM content means the total amount of these elements.

[Microstructure in Cross Section Parallel to Rolled Surface of Non-Oriented Electrical Steel Sheet]

The microstructure is composed of the crystal structure A and the crystal structure B in the cross section, parallel to the rolled surface, at the ¼ depth position of the sheet thickness from the rolled surface in the above-described non-oriented electrical steel sheet.

In the present embodiment, the crystal structure A is a region composed of crystal grains having a crystal grain size of 100 μm or more. On the other hand, the crystal structure B is a region, composed of crystal grains having a crystal grain size of less than 100 μm.

The crystal structure A is a region that is eroded and disappears by the additional heat treatment in which gradual heating is performed. In the cross section parallel to the rolled surface, if the area ratio of the crystal structure A is out of a range of 1 to 30%, it is difficult to avoid the degradation of the magnetic characteristics when grains are grown by the additional heat treatment. A detailed mechanism will be described below. Moreover, in a case where the area ratio of the crystal structure A is less than 1%, the crystal structure B is likely to be coarsened, and the strength of the non-oriented electrical steel sheet becomes low. Additionally, in a case where the area ratio of the crystal structure A exceeds 30%, the magnetic characteristics when grains are grown by the additional heat treatment degrade (deteriorate). Hence, the area ratio of the crystal structure A is 1 to 30%. A preferable lower limit of the area ratio of the crystal structure A is 5%, and a preferable upper limit thereof is 20%.

In the cross section parallel to the rolled surface, in a case where the area ratio of the crystal structure A is set to 1 to 30%, the area ratio of the crystal structure B becomes 70 to 99%. Hence, the machine characteristics of the non-oriented electrical steel sheet according to the present embodiment are mainly determined by the crystal structure B.

Additionally, the crystal structure B is a region where grains are grown by the additional heat treatment in which the gradual heating is performed.

If the average grain size of the crystal structure B is larger than 25 μm, the magnetic characteristics before the additional heat treatment are improved. However, it is difficult to satisfy the strength characteristic. Additionally, although a detailed mechanism will be described below, if the average grain size of the crystal structure B is larger than 25 μm, the magnetic characteristics when grains are grown by the additional heat treatment greatly degrade.

Hence, in the cross section parallel to the rolling direction, the average grain size of the crystal structure B needs to be 25 μm or less. The upper limit of the average grain size of the crystal structure B is preferably 20 μm and more preferably 15 μm.

In the present embodiment, microstructure in the cross section, parallel to the rolled surface, at, the ¼ depth position of the sheet thickness from the rolled surface may be the structure as above. This is because the microstructure at the ¼ depth position of sheet thickness from the rolled surface is a representative microstructure of the steel sheet and the characteristics of the steel sheet are greatly influenced.

[Method for Measuring Area Ratio of Crystal Structure A and Average Grain Size of Crystal Structure B]

The area ratio of the crystal structure A and the average grain size of the crystal structure B can be measured by the following method.

A sample having the cross section, parallel to the rolled surface, at the ¼ depth position of the sheet thickness from the rolled surface of the non-oriented electrical steel sheet is prepared by polishing or the like. After a polishing surface (hereinafter referred to as an observation surface) of the sample is adjusted by electrolytic polishing, crystal structure analysis using the electron ray backscattering diffracting method (EBSD) is performed.

By the EBSD analysis, a boundary of the observation surface in which a crystal orientation difference is 15° or more is determined as a grain boundary, an each region surrounded by this grain boundary is determined as one crystal grain, and a region (observation region) including 10000 or more crystal grains is observed. In the observation region, the diameter (equivalent circle diameter) when the crystal grains are an area equivalent to a circle is defined as a grain size. That is, the grain size means the equivalent circle diameter.

A region including crystal grains having a grain size of 100 μm or more is defined as the crystal structure A, and the area ratio thereof is obtained. Additionally, a region (that is the structure other than the crystal structure A) including crystal grains having a diameter of less than 100 μm is defined as the crystal structure B, and the average crystal grain size thereof is obtained. These measurements can be relatively simply performed by image analysis.

[Hardness of Crystal Structure A and Crystal Structure B]

In the non-oriented electrical steel sheet according to the present embodiment, the hardnesses of the crystal structure A and the crystal structure B satisfy Expression (1).

$$HvA/HvB \leq 1.000 \quad (1)$$

If HvA/HvB>1.000, the magnetic characteristics after the additional heat treatment degrade.

Here, "HvA" is the Vickers hardness of the crystal structure A at a test force (load) of 50 g, and "HvB" is the Vickers hardness of the crystal structure B at a test force (load) of 50 g. The Vickers hardnesses are measured according to JIS Z 2244 (2009).

More specifically, Vickers hardnesses are measured by the above-described method at least 20 points within the region of the crystal structure A, and an average value thereof is defined as the Vickers hardness HvA of the crystal structure A. Similarly, Vickers hardnesses, are measured by the above-described method at least 20 points within the region of the crystal structure B, and the average value thereof is defined as the Vickers hardness HvB of the crystal structure B.

On the other hand, since it is difficult to make HvA/HvB be less than 0.900. HvA/HvB may be set to 0.900 or more. The lower limit of HvA/HvB may be set to 0.950 or 0.970 or more.

[Definition of Microstructure]

In the non-oriented electrical steel sheet according to the present embodiment, as described above, the microstructure in the cross section, parallel to the rolled surface, at the ¼ depth position of the sheet thickness from the rolled surface is controlled such the "crystal structure A", the "crystal structure B", and the "ratio of the hardnesses of these crystal structures" are in predetermined ranges. These features will be described below. In the following description, there are also unsolved portions for details, and some of mechanisms of the unsolved portions are inferred.

The "crystal structure A" in the present embodiment generally has no great difference from a region, which is not eroded by "recrystallized grains", that is, "non-recrystallized structure", in the observation, of the optical microscope. However, the crystal structure A is sufficiently recovered by the final annealing and is extremely soft. For this reason, the crystal structure A is different from the general "non-recrystallized structure". If evaluation is made depending on an accumulated distortion amount (for example, IQ value) by the EBSD, the crystal structure A is closer to a recrystallized structure than the non-recrystallized structure.

Hence, in the present embodiment, the "crystal structure A" is defined in distinction from the general non-recrystallized structure.

The "crystal structure B" in the present embodiment is a region similar to the "recrystallized structure" in which crystals with a large orientation difference from a matrix are generated and grown due to nucleation from a processed structure. However, a region that, is not eroded by the recrystallized grains is also included in the crystal structure B in the present embodiment. Hence, the "crystal structure B" in the present embodiment is defined in distinction from the simple "recrystallized structure".

The non-oriented electrical steel sheet according to the present embodiment is characterized that the hardness of "the crystal structure A" is equal to or less than the hardness of "the crystal structure B" (that is, Expression (1) is satisfied).

Additionally, the non-oriented electrical steel sheet according to the present embodiment also has a feature in grain size distribution. As is clear from the above definition, the average grain size of the crystal structure B is as extremely small as 25 μm or less, excluding the crystal structure A composed of crystal grains having a grain size of 100 μm or more, which are present up to 30%. This means that crystal grains with a middle size of about 30 to 90 μm are hardly present in the microstructure. That is, in the non-oriented electrical steel sheet according to the present embodiment, the crystal grain size distribution is so-called duplex grains.

Generally, for example, if the grain size distribution is normal distribution, in a crystal structure that achieved the grain growth such that the grain size of 100 μm is present is achieved, a relatively large number of crystal grains of several tens of micrometers are also present, and the average grain size is about 50 μm.

The non-oriented electrical steel sheet according to the present embodiment, in which the crystal structure A and the crystal structure B are mixed in a predetermined ratio and the hardness ratio HvA/HvB satisfies Expression (1), has excellent strength and magnetic characteristics in a case where the sheet is used without performing the additional heat treatment (in a case where use as the blanks for rotors is assumed). On the other hand, in a case where the sheet is subjected to the additional heat treatment and is used (in a case where use as the blanks for stator cores is assumed), the iron loss is improved and the degradation of the magnetic flux density is limited, when crystal grains are grown by the additional heat treatment.

[Regarding Expression (2)]

In the above-described non-oriented electrical steel sheet, the magnetic flux density of the non-oriented electrical steel sheet before the additional heat treatment is performed is defined as BA(T). Moreover, the magnetic flux density of the non-oriented electrical steel sheet after the additional heat treatment in which the heating speed is 100° C./hr, the maximum attainment temperature is 800° C., and the retention time at 800° C. is 2 hours performed is defined as BB(T). In this case, in the non-oriented electrical steel sheet according to the present embodiment, the magnetic flux densities BA and BB satisfy the following Expression (2).

$$BB/BA \geq 0.980 \quad (2)$$

BB/BA is preferably 0.985 or more and more preferably 0.990 or more. Although, the upper limit of BB/BA is not particularly limited, the absence of property degradation due to the additional heat treatment (that is, BB/BA=1.000) is a target standard. However, there is also a case where, due to the additional heat treatment, grains of orientations that are preferable for the magnetic characteristics grow preferentially, and consequently BB/BA exceeds 1:000. However, even in this case, BB/BA rarely exceeds 1.015.

The heating speed, the maximum attainment temperature, and the retention time as described above are examples of the conditions of the additional heat treatment. As the conditions, values considered to be representative as conditions for stress relief annealing that are currently practically performed are used. However, the effect of limiting the decrease in the magnetic flux density by the additional heat treatment in the non-oriented electrical steel sheet according to the present embodiment can also be confirmed even in wider ranges, without being limited by these values in the heating speed, the maximum attainment temperature, and the retention time. For example, the effect is obtained in ranges in which the heating speed is 30 to 500° C./hr, the maximum attainment temperature is 750 to 850° C., and the retention time at 750° C. or more is 0.5 to 100 hours.

In the additional heat treatment, generally, as compared to the final annealing in which heat treatment is performed at a high temperature for a prolonged period of time to make grains grow, heating is performed at a low speed, and heat treatment is performed for a prolonged period of time to make grains grow.

Since general final annealing is performed at a heating speed of about 10° C./s (36000° C./hr), the temperature at this level can be presented as the upper limit of the heating speed of the additional heat treatment. However, if stress relief annealing of a general core is taken into consideration, the heating at such a high speed is difficult. Additionally, in a case where the heating speed is too fast, there is also a concern that the heating becomes uneven. Hence, the heating speed of the additional heat treatment is 500° C./hr or lower.

On the other hand, with an excessively low-speed heating speed, it is difficult to make the grain grow peculiar to the non-oriented electrical steel sheet according to the present embodiment as will be described below. For that reason, the lower limit of the heating speed of the additional heat treatment is 30° C./hr.

As for the maximum attainment temperature and the retention time, in consideration of general conditions of the stress relief annealing, the maximum attainment temperature is 750 to 850° C., and the retention time at 750° C. or more is 0.5 to 100 hours.

In the present embodiment, the reason why the degradation of the magnetic characteristics when grains are grown by the additional heat treatment, can be limited by controlling the ratio of the crystal structure A and the crystal structure B, the average grain size of the crystal structure B, the ratio of the hardnesses of the crystal structure A and the crystal structure B are controlled is not necessarily clear, but is presumed to be as follows.

In the non-oriented electrical steel sheet to be targeted in the present embodiment, the amount of nitrogen (N) and the amount of carbon (C) that form inclusions (precipitates) in steel are reduced to extremely low levels. Such precipitates to be formed in steel are fine precipitates in which the grain size is 1.0 μm or less, and many precipitates of 0.2 μm or less are also formed. Such fine precipitates, for example, fine precipitates having a grain size of 0.2 μm or less influence the magnetic characteristics or the like.

In a case where the fine precipitates are present in steel, pinned dislocations are less likely to disappear due to the precipitates, or regions (high dislocation, density region) where dislocations are accumulated are likely to be formed (likely to remain) around the precipitates.

Generally, it is said that crystals having random orientations are likely to be formed due to recrystallization from the high dislocation density regions around the precipitates. However, in the non-oriented electrical steel sheet according to the present embodiment as will be described below, slight heat treatment (final annealing treatment) is performed on the intermediate steel sheet after cold rolling or warm rolling, and the crystal structure A remains in the steel sheet after the final annealing. In a case where the precipitates are present in the crystal structure A, when the additional heat treatment is performed by the gradual heating after and the recrystallization is proceeded, development of crystal orientations, which are not preferable for the magnetic characteristics of the non-oriented electrical steel sheet, is promoted.

In contrast, in, a case where the recrystallization proceeds by the additional heat treatment in the gradual heating, it is considered that, if a dislocation structure (recovered structure) within the crystal structure A before the additional heat treatment is a homogeneous cellular structure (or a netlike two-dimensional structure) in which formation of the high dislocation density regions resulting from the precipitates or the like was limited, orientations preferable for the magnetic flux density develop in the subsequent additional heat treatment, and relatively high magnetic flux density is obtained.

If the dislocation structures of the crystal structure A are the homogeneous cellular structures, the ratio (HvA/HvB) of the Vickers hardness HvA of the crystal structure A and the Vickers hardness HvB of the crystal structure B satisfies Expression (1). That is, the crystal structure A that forms the cellular structure in which the dislocation structure is homogeneous or the simple two-dimensional structure become softer than a on-recrystallized structure that forms the complicated high dislocation density regions around the precipitates. In this case, the degradation of the magnetic characteristics is limited after the additional heat treatment.

Hence, in the non-oriented electrical steel sheet according to the present embodiment, Expression (1) is defined as an index showing that the dislocation structure of the crystal structure A is the homogeneous cellular structure.

[Manufacturing Method]

A method for manufacturing the above-described a non-oriented electrical steel sheet will be described. A manufacturing method to be described below is an example of the method for manufacturing the non-oriented electrical steel sheet according to the present embodiment. Hence, the non-oriented electrical steel sheet according to the present embodiment may be manufactured by manufacturing methods other than the manufacturing method to be described below.

The method for manufacturing the non-oriented electrical steel sheet according to the present embodiment includes hot rolling a slab to manufacturing a hot-rolled steel sheet (hot rolling step); performing annealing (hot-rolled sheet annealing) on the hot-rolled steel sheet (hot-rolled sheet annealing step); performing cold rolling or warm rolling on the hot-rolled steel sheet after the hot-rolled sheet annealing (a cold-rolling step or warm-rolling step), to manufactures an intermediate steel sheet, and performing final annealing on the intermediate steel sheet (final annealing step). Hereinafter the respective steps will be described.

[Hot Rolling Step]

In the hot rolling step, the hot-rolled steel sheet is manufactured by hot rolling the slab.

The slab is manufactured by a well-known method. For example, molten steel is manufactured by a converter or an electric furnace. The manufactured molten steel is subjected to secondary refining by a degassing facility or the like and is obtained as the molten steel having the above chemical composition. The slab is cast by a continuous casting method or an ingot making method using the molten, steel. The cast slab may be bloomed.

The hot, rolling is performed on the slab prepared by the above step. The preferable slab heating temperature in the hot rolling step is 1000 to 1200° C. If the slab heating temperature exceeds 1200° C., crystal grains are coarsened in the slab before the hot rolling. As in the chemical composition of the non-oriented electrical steel sheet according to the present embodiment, the structure of the steel sheet with a high Si content has ferrite single phase from the stage of the slab. Additionally, in a thermal history in the hot rolling step, the structure does not transform. For that reason, if the slab heating temperature is too high, the crystal grains are likely to be coarsened, and the coarse processed structure (flat structure) is likely to remain easily after the hot rolling. The coarse flat structure is less likely to disappear due to the recrystallization in the hot-rolled sheet annealing step that is the next step of the hot rolling step. In the hot-rolled sheet annealing structure, if the coarse flat structure remains, a structure required of the non-oriented electrical steel sheet according to the present embodiment is not obtained even if a subsequent step is preferable. Hence, the upper limit of the slab heating temperature is 1200° C.

On the other hand, if the slab heating temperature is too low, the workability of a slab becomes low, and the productivity in a general hot-rolled facility degrades. Hence, the lower limit of the slab heating temperature is 1000° C.

The upper limit of the slab heating temperature is preferably 1180° C. and more preferably 1160° C. The lower limit of the slab heating temperature is preferably 1050° C. and more preferably 1100° C.

Hot rolling conditions may be well-known conditions.

[Hot-Rolled Sheet Annealing Step]

In the hot-rolled sheet annealing step, the annealing (hot-rolled sheet annealing) is performed on the hot-rolled steel sheet manufactured by the hot rolling step. Thereby, in the structure of the hot-rolled steel sheet after the hot-rolled sheet annealing, the recrystallization ratio is set to 95% or more, and the average grain size of recrystallized grains is set to more than 50 μm. If the recrystallization ratio is less than 95% or the average grain size of the recrystallized grains is 50 μm or less, the crystal structure, of a product is accumulated in {111} and the magnetic characteristics are inferior.

In order to obtain the structure of the hot-rolled steel sheet after the hot-rolled sheet annealing as above, in the hot-rolled sheet annealing step, average heating speed $HR_{750\text{-}850}$ between 750 to 850° C. and maximum attainment temperature Tmax, among heating conditions, are as follows.

Average heating speed $HR_{750\text{-}850}$ between 750 to 850° C.: 50° C./sec or higher In the heating of the hot-rolled steel sheets in the hot-rolled sheet annealing, the average heating speed $HR_{750\text{-}850}$ in a range of 750 to 850° C. is 50° C./sec or higher. If the average heating speed $HR_{750\text{-}850}$ is set to 50° C./sec or higher as rapid heating, the recrystallization and the grain growth can be started with the dislocation density in the flat structure after the hot rolling being kept high. In this case, the flat structure can be made to disappear easily. Additionally, the recrystallization is started with the dislocation density being kept high in this way, and the structure in which grains are grown after that becomes the structure required of the non-oriented electrical steel sheet according to the present embodiment by the cold-rolling or warm-rolling step and the final annealing step to be performed subsequently.

If the average heating speed $HR_{750\text{-}850}$ is too slow, in the flat structure, recovery proceeds before the start of the recrystallization, or the recrystallization is completed in a so-called "in-situ recrystallization" manner. In this case, in the observation with an optical microscope, a difference from one subjected to the rapid heating is not clear. However, crystal grains formed by the recovery or the in-situ recrystallization have a difference in terms of crystal orientation from crystal grains formed by the recrystallization. For that reason, if the average heating speed $HR_{750\text{-}850}$ is too slow, the structure after the cold-rolled steel sheet and the recrystallization annealing does not become the structure required of the non-oriented electrical steel sheet according to the present embodiment. It is not necessary to limit the upper limit of the heating speed, and the upper limit of facility capacity becomes a substantial upper limit of the heating speed.

Even if the flat structure is recrystallized just after the hot-rolled sheet annealing, since the flat, structure is formed without undergoing any transformation, accumulation in orientations that are special as crystal orientations is likely to become strong. For that reason, this becomes a factor that the magnetic characteristics when grains are grown by the additional heat treatment in the gradual heating degrade even if the flat structure undergoes a preferable cold-rolling or warm-rolling step, and a preferable final annealing step later.

The lower limit of a temperature range where the above average heating speed $HR_{750-850}$ is applied is preferably 600° C. and more preferably 450° C. at where the recovery of the structure starts. The upper limit of a temperature range where the above average heating speed $HR_{750-850}$ is applied is preferably 900° C. and more preferably 950° C. That is, it is most preferable that the average heating speed between 450 to 950° C. is 50° C./sec or higher.

Maximum attainment temperature Tmax: 900 to 1150° C.

The maximum attainment temperature Tmax in the hot-rolled sheet annealing is 900 to 1150° C. If the maximum attainment temperature Tmax is too low, 95% or more of recrystallized structure is not obtained, the magnetic characteristics of an end product degrade. On the other hand, if the maximum attainment temperature Tmax is too high, the recrystallized grain structures are coarsened, and are likely to be cracked and broken in a subsequent step, and the yield decreases significantly:

The heat-treatment time of the hot-rolled sheet annealing is not particularly limited. The heat-treatment time is 20 seconds to 4 minutes.

[Cold-Rolling or Arm-Rolling Step]

The cold rolling or warm rolling is performed on the hot-rolled steel sheet after the hot-rolled sheet annealing step. Here, the warm rolling means a step in which rolling is performed to the hot-rolled steel sheet heated to 150 to 600° C.

It is preferable that the rolling reduction in the cold rolling or warm rolling is 83% or more. Here, the rolling reduction (%) is defined by the following Expression.

Rolling reduction (%)=(1−Sheet thickness of intermediate hot-rolled steel sheet after final cold or warm rolling/Sheet thickness of intermediate steel sheet before first cold or warm rolling start)×100

If the rolling reduction is less than 83%, the amounts of recrystallization nuclei that are required for the final annealing step that is the next step is insufficient. In this case, it is difficult to control the dispersion state of the crystal structure A appropriately. If the rolling reduction is 83% or more, a sufficient amount of recrystallization nuclei can be secured. This is considered that the recrystallization nuclei are dispersed and increased by introducing sufficient strain in the cold rolling or warm rolling. The intermediate steel sheet is manufactured by the above step.

[Final Annealing Step]

The final annealing is performed on the intermediate steel sheet manufactured by the cold-rolling or warm-rolling step. The conditions of the final annealing are as follows.

Maximum attainment, temperature (annealing temperature): 700 to 800° C.

In a case where the maximum attainment temperature during the final annealing is less than 700° C., the recrystallization does not proceed sufficiently. In this case, the magnetic characteristic of the non-oriented electrical steel sheet degrade. Moreover, in a case where the final annealing is performed by continuous annealing, the effect of correcting the sheet shape of the non-oriented electrical steel sheet is not sufficiently obtained. On the other hand, if the maximum attainment temperature during the final annealing exceeds 800° C., the area ratio of the crystal structure A becomes less than 1%, and the strength of the non-oriented electrical steel sheet decreases.

From a viewpoint of performing sufficient heating to obtain a desired structure without lowering the productivity, it is preferable that the soaking time at the maximum attainment temperature is 1 to 50 seconds.

Average cooling rate $CR_{700-500}$ in temperature range of 700 to 500° C.: 50° C./sec or higher It is considered that the average cooling rate $CR_{700-500}$ in a temperature range of 700 to 500° C. is related to formation of the dislocation structure of the crystal structure A of the non-oriented electrical steel sheet. If the average cooling rate $CR_{700-500}$ is less than 50° C./sec, dislocation dispersion in the crystal structure A becomes uneven and consequently, the hardness ratio HvA/HvB exceeds 1.000. In this case, development of the crystal orientations in the additional heat treatment is inhibited, and the magnetic characteristics after the additional heat treatment degrade. On the other hand, if the average cooling rate $CR_{700-500}$ is 50° C./sec or higher, this promotes homogenization of the dispersion of the dislocations in the crystal structures A, such, as confounding of the dislocations to the peripheries of the precipitates or fixation of the final cellular structure, and preferably acts on development of crystal orientations in {100} and in the vicinity thereof that contribute to improvements in the magnetic characteristics in the additional heat treatment. The lower limit of the average cooling rate $CR_{700-500}$ is preferably 100° C./sec and more preferably 200° C./sec. If the average cooling rate $CR_{700-500}$ exceeds 500° C./sec, there is a concern that temperature gradient in a longitudinal direction of the steel sheet may become too large and the steel sheet will be deformed. Thus, a preferable upper limit of the average cooling rate. $CR_{700-500}$ is 500° C./sec.

The non-oriented electrical steel sheet according to the present embodiment is manufactured by the above steps.

In the above-described manufacturing method, the sheet thickness of the non-oriented electrical steel sheet is set to a final, sheet thickness in one cold rolling or warm-rolling step after the hot-rolled sheet annealing step.

[Insulation Coating Step]

In the above manufacturing method, a step (insulation coating step) of forming insulation coating on the surface of the non-oriented electrical steel sheet after the final annealing step in order to reduce the iron loss may be further performed. The insulation coating step may be performed by a well-known method. In order to ensure excellent punchability, it is preferable to form organic coating containing resin. Meanwhile in a case where emphasis is placed on weldability, it is preferable to form a half-organic or inorganic coating.

Inorganic ingredients are, for example, ingredients based on dichromic acid-boric acid, phosphoric acid, silica, and the like. Organic ingredients are, for example, general resins based acrylics, acrylic styrene, acrylic silicon, silicone, polyester, epoxy, and fluorine. In a case where paintability is taken into consideration, preferable resin is emulsion type resin. Insulation coating that exhibits bonding performance by heating and/or pressurizing may be performed. The insulation, coating having the bonding performance is, for example, resins based on acrylics, phenol, epoxy, and melamine.

EXAMPLE 1

Hereinafter, aspects of the invention will be more specifically described by way of examples. These embodiments are examples for confirming the effects of the invention, and do not limit the invention.

[Manufacturing Step]

Slabs having the chemical compositions shown in Table 1 were prepared.

TABLE 1

| Steel | Chemical Compositions (Unit is mass % and remainder is Fe and impurities) | | | | | | | | | | | | | |
|---|---|---|---|---|---|---|---|---|---|---|---|---|---|---|
| Type | C | Si | Mn | P | S | Al | N | Sn | Sb | Cr | Ni | Cu | Ca | REM |
| A | 0.0012 | 3.2 | 0.6 | 0.01 | 0.0007 | 0.7 | 0.0018 | — | — | — | — | — | — | — |
| B | 0.0012 | 3.2 | 0.6 | 0.01 | 0.0024 | 0.7 | 0.0016 | — | — | — | — | — | — | — |
| C | 0.0011 | 3.5 | 0.4 | 0.04 | 0.0015 | 0.003 | 0.0023 | — | — | — | — | — | — | — |
| D | 0.0008 | 3.5 | 0.4 | 0.04 | 0.0033 | 0.004 | 0.0024 | — | — | — | — | — | — | — |
| E | 0.0016 | 3.1 | 1.0 | 0.02 | 0.0005 | 0.9 | 0.0014 | 0.04 | — | — | — | — | — | — |
| F | 0.0011 | 3.1 | 1.0 | 0.02 | 0.0030 | 0.9 | 0.0011 | 0.04 | — | — | — | — | — | — |
| G | 0.0007 | 3.3 | 2.1 | 0.01 | 0.0003 | — | 0.0014 | — | — | — | — | 0.6 | — | — |
| H | 0.0012 | 3.3 | 2.1 | 0.01 | 0.0022 | — | 0.0011 | — | — | — | — | 0.08 | — | — |
| I | 0.0013 | 3.1 | 0.2 | 0.01 | 0.0013 | 0.3 | 0.0014 | — | — | — | — | — | 0.002 | — |
| J | 0.0014 | 3.1 | 0.2 | 0.01 | 0.0024 | 0.3 | 0.0011 | — | — | — | — | — | 0.004 | — |
| K | 0.0091 | 3.1 | 0.2 | 0.01 | 0.0014 | 0.3 | 0.0012 | — | — | — | — | — | — | — |
| L | 0.0015 | 4.8 | 0.1 | 0.01 | 0.0011 | 0.002 | 0.0013 | — | — | — | — | — | — | — |
| M | 0.0019 | 3.2 | 0.2 | 0.01 | 0.0012 | 0.6 | 0.0012 | — | 0.012 | — | — | — | — | — |
| N | 0.0017 | 3.2 | 0.2 | 0.01 | 0.0013 | 0.3 | 0.0011 | — | — | 0.7 | — | — | — | — |
| O | 0.0013 | 3.2 | 0.2 | 0.01 | 0.0012 | 0.6 | 0.0014 | — | — | — | 0.1 | — | — | — |
| P | 0.0015 | 3.2 | 0.2 | 0.01 | 0.0013 | 0.6 | 0.0011 | — | — | — | — | — | — | 0.003 |
| Q | 0.0150 | 3.2 | 0.2 | 0.01 | 0.0011 | 0.3 | 0.0011 | — | — | — | — | — | — | — |
| R | 0.0013 | 2.8 | 0.2 | 0.01 | 0.0012 | 0.7 | 0.0015 | — | — | — | — | — | — | — |
| S | 0.0011 | 3.2 | 3.4 | 0.01 | 0.0015 | 0.3 | 0.0013 | — | — | — | — | — | — | — |

Hot-rolled steel sheets having a sheet thickness of 2.2 mm were manufactured by heating the slabs having chemical compositions shown in Table 1 at slab heating temperatures shown in Table 2 and performing hot rolling. Finish temperatures FT (° C.) and coiling temperatures CT (° C.) during the hot rolling were as shown in Table 2.

TABLE 2

| | | Rolling Condition | | | | Final annealing | After Final annealing | | | |
|---|---|---|---|---|---|---|---|---|---|---|
| Test Nos. | Steel Type | Slab Heating Condition (° C.) | FT (° C.) | CT (° C.) | Finish Sheet Thickness (mm) | Maximum Attainment Temperature (° C.) | Crystal Structure A Area Ratio (%) | Crystal Structure B Average Grain Size (μm) | HvA | HvB |
| 1-1 | A | 1080 | 920 | 610 | 2.2 | 750 | 5 | 13 | 233 | 235 |
| 1-2 | A | 1130 | 930 | 600 | 2.2 | 750 | 7 | 12 | 233 | 236 |
| 1-3 | A | 1180 | 895 | 620 | 2.2 | 750 | 9 | 12 | 234 | 236 |
| 1-4 | A | 1210 | 895 | 615 | 2.2 | 750 | 9 | 13 | 238 | 237 |
| 1-5 | A | 1240 | 905 | 620 | 2.2 | 750 | 15 | 14 | 239 | 236 |
| 1-6 | A | 1150 | 910 | 605 | 2.2 | 810 | 0 | 20 | — | 231 |
| 1-7 | B | 1080 | 905 | 610 | 2.2 | 750 | 7 | 13 | 235 | 239 |
| 1-8 | B | 1130 | 915 | 630 | 2.2 | 750 | 7 | 14 | 236 | 239 |
| 1-9 | B | 1180 | 920 | 630 | 2.2 | 750 | 8 | 12 | 236 | 239 |
| 1-10 | B | 1210 | 895 | 605 | 2.2 | 750 | 11 | 12 | 240 | 238 |
| 1-11 | B | 1240 | 910 | 620 | 2.2 | 750 | 16 | 12 | 242 | 239 |
| 1-12 | B | 1150 | 920 | 630 | 2.2 | 810 | 0 | 20 | — | 230 |
| 1-13 | G | 1150 | 895 | 620 | 2.2 | 750 | 19 | 10 | 257 | 261 |
| 1-14 | H | 1150 | 905 | 620 | 2.2 | 750 | 21 | 9 | 258 | 263 |
| 1-15 | I | 1150 | 900 | 630 | 2.2 | 740 | 19 | 16 | 227 | 230 |
| 1-16 | J | 1150 | 900 | 615 | 2.2 | 740 | 24 | 14 | 229 | 232 |
| 1-17 | K | 1160 | 900 | 600 | 2.2 | 750 | 8 | 14 | 230 | 233 |
| 1-18 | L | 1160 | 920 | 600 | 2.2 | 750 | 15 | 14 | 256 | 258 |
| 1-19 | M | 1170 | 890 | 600 | 2.2 | 750 | 10 | 13 | 236 | 237 |
| 1-20 | N | 1170 | 890 | 610 | 2.2 | 750 | 18 | 14 | 239 | 241 |
| 1-21 | O | 1170 | 890 | 600 | 2.2 | 750 | 10 | 14 | 237 | 239 |
| 1-22 | P | 1170 | 900 | 600 | 2.2 | 750 | 7 | 14 | 229 | 232 |
| 1-23 | A | 1080 | 920 | 610 | 2.2 | 750 | 2 | 13 | 233 | 235 |
| 1-24 | Q | 1170 | 900 | 620 | 2.2 | 750 | 8 | 14 | 228 | 230 |
| 1-25 | R | 1170 | 900 | 600 | 2.2 | 750 | 10 | 14 | 205 | 206 |
| 1-26 | S | 1160 | 900 | 550 | 2.2 | 750 | 1 | 12 | 224 | 224 |

TABLE 2-continued

| Test Nos. | After Final annealing HvA/HvB | TS (MPa) | Magnetic Flux Density BA (T) | $W_{10/400}$ (W/kg) | After Additional Heat Treatment Magnetic Flux Density BB (T) | BB/BA | $W_{10/400}$ (W/kg) | Remarks |
|---|---|---|---|---|---|---|---|---|
| 1-1 | 0.991 | 640 | 1.67 | 20.5 | 1.66 | 0.994 | 12.1 | Invention Steel |
| 1-2 | 0.987 | 644 | 1.67 | 20.6 | 1.66 | 0.994 | 12.3 | Invention Steel |
| 1-3 | 0.992 | 647 | 1.67 | 20.9 | 1.66 | 0.994 | 12.3 | Invention Steel |
| 1-4 | 1.004 | 650 | 1.67 | 21.8 | 1.62 | 0.970 | 12.7 | Comparative Steel |
| 1-5 | 1.013 | 650 | 1.67 | 22.3 | 1.61 | 0.964 | 13.1 | Comparative Steel |
| 1-6 | — | 590 | 1.67 | 19.9 | 1.66 | 0.994 | 12.3 | Comparative Steel |
| 1-7 | 0.983 | 660 | 1.66 | 20.6 | 1.66 | 1.000 | 12.6 | Comparative Steel |
| 1-8 | 0.987 | 655 | 1.66 | 20.6 | 1.66 | 1.000 | 12.6 | Comparative Steel |
| 1-9 | 0.987 | 654 | 1.66 | 20.7 | 1.65 | 0.994 | 12.8 | Comparative Steel |
| 1-10 | 1.008 | 657 | 1.66 | 21.9 | 1.61 | 0.970 | 13.1 | Comparative Steel |
| 1-11 | 1.013 | 658 | 1.66 | 22.7 | 1.60 | 0.964 | 13.2 | Comparative Steel |
| 1-12 | — | 593 | 1.66 | 19.7 | 1.65 | 0.994 | 13.1 | Comparative Steel |
| 1-13 | 0.985 | 695 | 1.66 | 18.8 | 1.67 | 1.006 | 12.4 | Invention Steel |
| 1-14 | 0.981 | 677 | 1.67 | 18.5 | 1.62 | 0.970 | 12.7 | Comparative Steel |
| 1-15 | 0.987 | 647 | 1.67 | 18.9 | 1.69 | 1.012 | 11.9 | Invention Steel |
| 1-16 | 0.987 | 647 | 1.67 | 18.9 | 1.63 | 0.976 | 12.6 | Comparative Steel |
| 1-17 | 0.987 | 649 | 1.67 | 22.5 | 1.66 | 0.994 | 12.5 | Invention Steel |
| 1-18 | 0.992 | 756 | 1.65 | 19.8 | 1.65 | 1.000 | 11.6 | Invention Steel |
| 1-19 | 0.996 | 645 | 1.66 | 21.5 | 1.65 | 0.994 | 12.1 | Invention Steel |
| 1-20 | 0.992 | 651 | 1.65 | 21.4 | 1.65 | 1.000 | 12.3 | Invention Steel |
| 1-21 | 0.992 | 645 | 1.66 | 21.5 | 1.65 | 0.994 | 12.1 | Invention Steel |
| 1-22 | 0.987 | 646 | 1.66 | 21.6 | 1.65 | 0.994 | 12.2 | Invention Steel |
| 1-23 | 0.991 | 650 | 1.67 | 20.5 | 1.65 | 0.988 | 12.2 | Invention Steel |
| 1-24 | 0.991 | 642 | 1.66 | 23.5 | 1.63 | 0.982 | 14.5 | Comparative Steel |
| 1-25 | 0.995 | 580 | 1.68 | 21.1 | 1.66 | 0.988 | 12.2 | Comparative Steel |
| 1-26 | 1.000 | 642 | 1.66 | 22.5 | 1.62 | 0.976 | 16.5 | Comparative Steel |

The hot-rolled sheet annealing was performed on the manufactured hot-rolled steel sheets. In the hot-rolled sheet annealing, average heating speeds $HR_{750-850}$ in a temperature range of 750 to 850° C. were 50° C./sec in any test numbers. Moreover, maximum attainment temperatures were 900° C., and retention times were 2 minutes.

Intermediate steel sheets were manufactured by performing the cold rolling for Test Nos. 1-1 to 1-22 and Test Nos. 1-24 to 1-26 and warm rolling for 200° C. on Test No. 1-23, with respect to the hot-rolled steel sheets after the hot-rolled sheet annealing. Rolling reductions during the cold rolling were 88% in any test numbers. The intermediate steel sheets (cold-rolled steel sheets) having a sheet thickness of 0.27 mm were manufactured by the above step.

The final annealing was performed on the intermediate steel sheets. Maximum attainment temperatures in the final annealing were as shown in Table 2, and retention times were 30 seconds in any test numbers. Additionally, average cooling rates $CR_{700-500}$ in a temperature range of 700 to 500° C. were 100° C./sec in any test numbers.

The non-oriented electrical steel sheets after the final annealing were coated with well-known insulating films containing phosphoric-acid-based inorganic substance and epoxy-based organic substance. The non-oriented electrical steel sheets of the respective test numbers were manufactured by the above step. As a result of check, analysis the non-oriented electrical steel sheets after the final, annealing, the chemical compositions were as shown in Table 1.

[Evaluation Test]

Next evaluation tests were performed on the manufactured non-oriented electrical steel sheets of the respective test numbers.

[Evaluation Test for Non-oriented Electrical Steel Sheet After Final Annealing]

[Crystal Structure Measurement Test]

Samples including cross sections parallel to rolled surfaces of the non-oriented electrical steel sheets after the final annealing of the respective test numbers were taken. The above cross sections were determined as cross sections at ¼ depth positions of sheet thicknesses in a sheet thickness direction from the surfaces. Sample surfaces equivalent to the cross sections were determined as observation surfaces.

After the observation surfaces of the samples are adjusted by the electrolytic polishing, the crystal structure analysis using the electron ray backscattering diffracting method (EBSD) was performed. By the EBSD analysis, boundaries of the observation surfaces in which crystal orientation differences become 15° or more are determined as grain boundaries, an each region surrounded by each grain boundary is determined as being one crystal grain, and regions (observation regions) including 10000 or more crystal grains were determined as the observation regions. In the observation regions, the diameter (equivalent circle diameter) of a circle having an area equivalent to the area of each crystal grain was defined as a grain size of each crystal grain.

A region composed of crystal grains having a grain size of 100 μm or more was defined as the crystal structure A, and the area ratio (%) thereof was obtained. Additionally, a region composed of crystal grains having a grain size of less than 100 μm was defined as the crystal structure B, and the average crystal grain size (μm) thereof was obtained. These measurements were obtained by the image analysis of the observation regions.

[Hardness of Crystal Structure]

Vickers hardness tests according to JIS Z 2244 (2009) were performed at twenty arbitrary points within the region of the crystal structure A. A test force (load) was 50 g. An average value of the obtained Vickers hardnesses was determined as the hardness HvA of the crystal structure A.

Similarly Vickers hardness tests according to JIS Z 2244 (2009) were performed at twenty arbitrary points within the region of the crystal structure B. The test force was 50 g. An average value of the obtained Vickers hardnesses was determined as the hardness HvB of the crystal structure B.

[Tension Test]

JIS No. 5 tension test pieces defined in JIS Z 2241 (2011) were made from the non-oriented electrical steel sheets of the respective test numbers. Parallel parts of the tension test pieces were parallel to the rolling direction of the non-oriented electrical steel sheets. Using the made tension test pieces tension tests were performed at normal temperature in the atmosphere according to JIS Z 2241 (2011), and tensile strengths TS (MPa) were obtained.

[Magnetic Characteristic Evaluation Test]

Epstein test pieces, which are cut out in the rolling direction (L direction) and an orthogonal-to-rolling direction (C direction), respectively, from the non-oriented electrical steel sheets according to JIS C 2550-1 (2011) of the respective test numbers, were prepared. Magnetic characteristics (magnetic flux density $B_{50}$ and iron loss $W_{10/400}$) were obtained by performing electrical steel strip test methods according, to JIS C 2550-1 (2011) and 2550-3 (2011) on the Epstein test pieces. The magnetic flux density $B_{50}$ obtained by a main test before the additional heat treatment was defined as magnetic flux density BA(T).

[Magnetic Characteristic Evaluation Test in Non-oriented Electrical Steel Sheet After Additional Heat Treatment]

Epstein test pieces, which are cut out in the rolling direction (L direction) and an orthogonal-to-rolling direction (C direction), respectively, from the on-oriented electrical steel sheets according to JIS C 2550-1 (2011) of the respective test numbers, were prepared. The additional heat treatment was performed on the Epstein test pieces in a nitrogen atmosphere, with the heating speed being 100° C./hr, the maximum attainment temperature being 800° C., and the retention time at the maximum attainment temperature of 800° C. being 2 hours.

The magnetic characteristics (magnetic flux density $B_{50}$ and iron loss $W_{10/400}$) were obtained according to JIS C 2550-1 (2011) and 2550-3 (2011) on the Epstein test pieces of after the additional heat treatment. The magnetic flux density $B_{50}$ obtained by the main test after the additional heat treatment was defined as magnetic flux density BB(T).

[Test Result]

The results obtained by the above evaluation test are shown in Table 2.

Chemical compositions of non-oriented electrical steel sheets of Test Nos. 1-1 to 1-3, 1-13, 1-15, and 1-17 to 1-23 were appropriate, and manufacturing conditions were also appropriate. As a result, the area ratios of the crystal, structures A were 1 to 30%, and the average grain sizes of the crystal structures B were 25 μm or less. Moreover, the ratios (HvA/HvB) of the hardness HvA of each crystal structure A to the hardnesses HvB of each crystal structure B was 1.000 or less. Tensile strengths TS were 600 MPa or more, and excellent strength was exhibited.

Moreover, magnetic flux densities BB after the additional heat treatment were 1.65 T or more, iron losses $W_{10/400}$ were less than 12.5 W/kg, and excellent magnetic characteristics were obtained. Moreover, the ratio (BB/BA) of each magnetic flux density BB after the additional heat treatment to each magnetic flux density BA during the additional heat treatment was 0.980 or more, and a decrease in magnetic flux density was limited even after the additional heat treatment.

Meanwhile, slab heating temperatures were too high in Test Nos. 1-4 and 1-5. For that reason, hardness ratios HvA/HvB exceeded 1.000. As a result, magnetic flux densities BB after the additional heat treatment were as low as less than 1.65 T, and BB/BA also became less than 0.980.

In Test No. 1-6, the chemical composition was appropriate and slab heating temperatures was also appropriate. However, maximum attainment temperature in the final annealing exceeded 800° C. For that reason, the area ratio of the crystal structure A became less than 1%, and tensile strength TS was as low as, less than 600 MPa.

The S contents were all too high in Test Nos. 1-7 to 1-12, 1-14, and 1-16. For that reason, iron losses $W_{10/400}$ were larger than 12.5 W/kg. Slab heating temperatures were also too high in Test Nos. 1-10 and 1-11. For that reason, hardness ratios HvA/HvB exceeded 1.000. As a result, magnetic flux densities BB after the additional heat treatment were as low as less than 1.65 T, and BB/BA also became less than 0.980.

In Test No. 1-24, the C content was out of the range of the invention. As a result, magnetic flux density BB after the additional heat treatment was as low as less than 1.65 T, and iron loss $W_{10/400}$ was larger than 12.5 W/kg.

In Test No. 1-25, Si content was out of the range of the invention. As a result sufficient high-strengthening cannot be achieved.

In Test No. 1-26, Mn content was out of the range of the invention. As a result, magnetic flux density BB after the additional heat treatment was as low as less than 1.65 T, iron loss $W_{10/400}$ were larger than 12.5 W/kg, and BB/BA also became less than 0.980.

EXAMPLE 2

Slabs of steel types A, B, C, and D in Table 1 were prepared. Hot-rolled steel sheets were manufactured by heating the prepared slabs at a slab heating temperature of 1120° C. and performing the hot rolling. Finish temperatures FT during the hot rolling were 890 to 920° C., and coiling temperatures CT were 590 to 630° C.

The hot-rolled sheet annealing was performed under conditions shown in Table 3 on the manufactured hot-rolled steel sheets. The hot-rolled steel sheets after the hot-rolled sheet annealing was performed were pickled. Intermediate steel sheets (cold-rolled steel sheets) having a sheet thickness of 0.27 mm were manufactured by performing the cold rolling at a rolling reduction of 88% on the hot-rolled steel sheets after the pickling.

Additionally, samples were collected from portions of the hot-rolled steel sheets after the hot-rolled sheet annealing, microstructures were observed in cross sections orthogonal to the rolling direction, and recrystallization ratios and average grain sizes of recrystallized grains were observed.

Specifically, each recrystallization ratio was defined by the ratio of a portion excluding a region appearing in black by natal etching when each optical microscope structure is observed. Additionally, as for the average grain size of the recrystallized grains, one obtained by measuring average intercept length by a line-segment method, using a microstructure photograph in which all thicknesses fall within a visual field, and multiplying the measured average intercept length by 1.13 was defined as the grain size. In that case, line segments are made parallel to the sheet thickness direction, and the number of line segments was determined such that the number of points where grain boundaries and line segments intersect each other exceeds 200.

As a result, in Test Nos. 2-3, 2-4, and 2-12, the recrystallization ratios were 95% or more, and the average grain sizes of the recrystallized grains were more than 50 μm. In contrast, in Test No. 2-1, recrystallization ratio was 93%.

TABLE 3

| | | Rolling Sheet Annealing Condition | | | Final annealing | After Final annealing | | | |
|---|---|---|---|---|---|---|---|---|---|
| Test Nos. | Steel Type | $HR_{750-850}$ (° C./sec) | Maximum Attainment Temperature (° C.) | Retention Time (min) | Maximum Attainment Temperature (° C.) | Crystal Structure A Area Ratio (%) | Crystal Structure B Average Grain Size (μm) | HvA | HvB |
| 2-1 | A | 20 | 980 | 0.5 | 750 | 8 | 14 | 239 | 238 |
| 2-2 | A | 40 | 980 | 0.5 | 750 | 7 | 14 | 240 | 238 |
| 2-3 | A | 60 | 980 | 0.5 | 750 | 2 | 12 | 234 | 238 |
| 2-4 | A | 80 | 980 | 0.5 | 750 | 3 | 13 | 234 | 238 |
| 2-5 | A | 50 | 980 | 0.5 | 840 | 0 | 26 | — | 233 |
| 2-6 | B | 20 | 980 | 0.5 | 750 | 9 | 13 | 242 | 238 |
| 2-7 | B | 40 | 980 | 0.5 | 750 | 6 | 13 | 241 | 238 |
| 2-8 | B | 60 | 980 | 0.5 | 750 | 2 | 13 | 236 | 238 |
| 2-9 | B | 80 | 980 | 0.5 | 750 | 2 | 12 | 235 | 238 |
| 2-10 | B | 50 | 980 | 0.5 | 840 | 0 | 27 | — | 233 |
| 2-11 | C | 30 | 980 | 0.5 | 750 | 10 | 13 | 240 | 238 |
| 2-12 | C | 70 | 980 | 0.5 | 750 | 2 | 14 | 236 | 238 |
| 2-13 | D | 30 | 980 | 0.5 | 750 | 8 | 13 | 240 | 238 |
| 2-14 | D | 70 | 980 | 0.5 | 750 | 3 | 13 | 235 | 238 |
| 2-15 | A | 60 | 980 | 0.5 | 840 | 1 | 26 | 234 | 234 |

| | After Final annealing | | | | After Additional Heat Treatment | | | |
|---|---|---|---|---|---|---|---|---|
| Test Nos. | HvA/HvB | TS (MPa) | Magnetic Flux Density BA (T) | $W_{10/400}$ (W/kg) | Magnetic Flux Density BB (T) | BB/BA | $W_{10/400}$ (W/kg) | Remarks |
| 2-1 | 1.004 | 635 | 1.67 | 21.5 | 1.62 | 0.970 | 12.8 | Comparative Steel |
| 2-2 | 1.008 | 638 | 1.67 | 21.6 | 1.61 | 0.964 | 12.6 | Comparative Steel |
| 2-3 | 0.983 | 642 | 1.67 | 20.4 | 1.66 | 0.994 | 12.1 | Invention Steel |
| 2-4 | 0.983 | 645 | 1.67 | 20.3 | 1.65 | 0.988 | 12.0 | Invention Steel |
| 2-5 | — | 587 | 1.67 | 19.4 | 1.66 | 0.994 | 12.5 | Comparative Steel |
| 2-6 | 1.017 | 636 | 1.67 | 22.1 | 1.62 | 0.970 | 12.7 | Comparative Steel |
| 2-7 | 1.013 | 637 | 1.67 | 21.8 | 1.62 | 0.970 | 12.9 | Comparative Steel |
| 2-8 | 0.992 | 645 | 1.67 | 20.7 | 1.66 | 0.994 | 12.6 | Comparative Steel |
| 2-9 | 0.987 | 649 | 1.67 | 20.6 | 1.65 | 0.988 | 12.5 | Comparative Steel |

TABLE 3-continued

| | | | | | | | | |
|---|---|---|---|---|---|---|---|---|
| 2-10 | — | 576 | 1.67 | 19.3 | 1.66 | 0.994 | 12.7 | Comparative Steel |
| 2-11 | 1.008 | 642 | 1.66 | 21.5 | 1.61 | 0.970 | 13.2 | Comparative Steel |
| 2-12 | 0.992 | 640 | 1.66 | 20.8 | 1.65 | 0.994 | 12.3 | Invention Steel |
| 2-13 | 1.008 | 639 | 1.66 | 21.4 | 1.60 | 0.964 | 13.5 | Comparative Steel |
| 2-14 | 0.987 | 638 | 1.65 | 20.6 | 1.64 | 0.994 | 13.6 | Comparative Steel |
| 2-15 | 1.000 | 585 | 1.67 | 19.2 | 1.66 | 0.994 | 12.4 | Comparative Steel |

The final annealing was performed on the intermediate steel sheets. Maximum attainment temperatures in the final annealing were as shown in Table 3. All retention times were 30 seconds. All the average cooling rates $CR_{700-500}$ were 100° C./sec.

The non-oriented electrical steel sheets after the final annealing were coated with well-known insulating films containing phosphoric-acid-based inorganic substance and epoxy-based organic substance. The non-oriented electrical steel sheets of the respective test numbers were manufactured by the above step. As a result of check analysis, the non-oriented electrical steel sheets after the final annealing, the chemical compositions were as shown in Table 1.

[Evaluation Test]

With respect to the non-oriented electrical steel sheets after the final annealing, area ratios (%) of crystal structures A, average crystal grain sizes (μm) of crystal structures B, Vickers hardnesses HvA of the crystal structures A, the Vickers hardnesses HvB of the crystal structures B, tensile strengths TS (MPa), and magnetic flux densities BA and iron losses $W_{10/400}$ before the additional heat treatment were obtained by the same method as that of Example 1.

Moreover, magnetic characteristics (magnetic flux densities BB and iron losses $W_{10/400}$) of the non-oriented electrical steel sheets after the additional heat treatment were obtained by the same method as Example 1.

[Test Result]

The obtained results are shown in Table 3.

Chemical compositions of non-oriented electrical steel sheets of Test Nos, 2-3, 2-4, and 2-12 were appropriate, and manufacturing conditions were also appropriate. As a result, the area ratios of the crystal structures A were 1 to 30%, and the average grain sizes of the crystal structures B were 25 μm or less. Moreover, the ratios (HvA/HvB) of the hardness HvA of each crystal structure A to the hardnesses HvB of each crystal structure B was 1.000 or less. For that reason, tensile strengths TS were 600 MPa or more, and excellent strength was exhibited.

Moreover, magnetic flux densities BB after the additional heat treatment were 1.65 T or more, iron losses $W_{10/400}$ were less than 12.5 W/kg, and excellent magnetic characteristics were obtained. Moreover, the ratio (BB/BA) of each magnetic flux density BB after the additional heat treatment to each magnetic flux density BA during the additional heat treatment was 0.980 or more, and a decrease in magnetic flux density was limited even after the additional heat treatment.

Meanwhile, in Test Nos. 2-1, 2-2, and 2-11, average heating speeds $HR_{750-850}$ were less than 50° C./sec. For that reason, hardness ratios HvA/HvB exceeded 1.000. As a result, magnetic flux densities BB after the additional heat treatment were as low as less than 1.65 T, and BB/BA also became less than 0.980.

In Test No. 2-5, maximum attainment temperature in the final annealing exceeded 800° C. For that reason, the area ratio of the crystal structure A became less than 1%, and tensile strength TS was as low as less than 600 MPa.

The S content was high in Test Nos. 2-6 to 2-10, 2-13, and 2-14. For that reason, iron losses $W_{10/400}$ were 12.5 W/kg or more. Moreover, in Test Nos. 2-6 and 2-7, average heating speeds $HR_{750-850}$ were less than 50° C./sec. For that reason, hardness ratios HvA/HvB exceeded 1.000. As a result, magnetic flux densities BB after the additional heat treatment were as low as less than 1.65 T, and BR/BA also became less than 0.980.

Moreover, in Test No. 2-11 average heating speed $HR_{750-850}$ was less than 50° C./sec. For that reason, hardness ratio HvA/HvB exceeded 1.000. As a result, magnetic flux density BB after the additional heat treatment was as low as less than 1.65 T, and BB/BA also became less than 0.980.

In Test No. 2-15, maximum attainment temperature in the final annealing exceeded 800° C. For that reason, the average grain size of the crystal structure B became larger than 25 μm and tensile strength TS was as low as less than 600 MPa.

EXAMPLE 3

Slabs of steel types C to F in Table 1 were prepared. Hot-rolled steel sheets were manufactured by heating the prepared slabs at a slab heating temperature of 1180° C. and performing the hot rolling. Finish temperatures FT during the hot rolling were 890 to 920° C., and coiling temperatures CT were 590 to 630° C.

The hot-rolled sheet annealing was, performed on the manufactured hot-rolled steel sheets. In the hot-rolled sheet annealing, average heating speeds $HR_{750-850}$ in a temperature range of 750 to 850° C. were 50° C./sec in any test numbers. Moreover, the maximum attainment temperatures were 900° C., and the retention times were 2 minutes.

The hot-rolled steel sheets after the hot-rolled sheet annealing was performed were pickled. Intermediate steel sheets (cold-rolled steel sheets) having a sheet thickness of 0.25 mm were manufactured by performing the cold rolling at a rolling reduction of 87% on the hot-rolled steel sheets after the pickling.

The final annealing was performed on the intermediate steel sheets. Annealing temperatures (maximum attainment temperatures), retention times, and average cooling rates $CR_{700-500}$ in the final annealing were as shown in Table 4.

The non-oriented electrical steel sheets after the final annealing were coated with well-known insulating films containing phosphoric-acid-based inorganic substance and epoxy-based organic substance. The non-oriented electrical steel sheets of the respective test numbers were manufactured by the above step. As a result of check analysis the non-oriented electrical steel sheets after the final annealing, the chemical compositions were as shown in Table 1.

TABLE 4

| Test Nos. | Steel Type | Final annealing Condition: Maximum Attainment Temperature (° C.) | Retention Time (min) | $CR_{700-500}$ (° C./s) | After Final annealing: Crystal Structure A Area Ratio (%) | Crystal Structure B Average Grain Size (μm) | HvA | HvB | HvA/HvB |
|---|---|---|---|---|---|---|---|---|---|
| 3-1 | C | 750 | 0.5 | 20 | 8 | 12 | 237 | 236 | 1.004 |
| 3-2 | C | 750 | 0.5 | 40 | 8 | 13 | 238 | 237 | 1.004 |
| 3-3 | C | 750 | 0.5 | 70 | 4 | 13 | 232 | 236 | 0.983 |
| 3-4 | C | 750 | 0.5 | 110 | 3 | 13 | 233 | 236 | 0.987 |
| 3-5 | C | 830 | 0.5 | 50 | 0 | 21 | — | 230 | — |
| 3-6 | D | 750 | 0.5 | 20 | 9 | 12 | 241 | 237 | 1.017 |
| 3-7 | D | 750 | 0.5 | 40 | 10 | 13 | 240 | 237 | 1.013 |
| 3-8 | D | 750 | 0.5 | 70 | 2 | 13 | 235 | 237 | 0.992 |
| 3-9 | D | 750 | 0.5 | 110 | 3 | 13 | 234 | 237 | 0.987 |
| 3-10 | D | 830 | 0.5 | 50 | 0 | 22 | — | 229 | — |
| 3-11 | E | 750 | 0.5 | 40 | 7 | 14 | 242 | 238 | 1.017 |
| 3-12 | E | 750 | 0.5 | 80 | 3 | 14 | 235 | 238 | 0.987 |
| 3-13 | F | 750 | 0.5 | 40 | 7 | 13 | 241 | 236 | 1.021 |
| 3-14 | F | 750 | 0.5 | 80 | 2 | 13 | 233 | 237 | 0.983 |

| Test Nos. | After Final annealing: TS (MPa) | Magnetic Flux Density BA (T) | $W_{10/400}$ (W/kg) | After Additional Heat Treatment: Magnetic Flux Density BB (T) | BB/BA | $W_{10/400}$ (W/kg) | Remarks |
|---|---|---|---|---|---|---|---|
| 3-1 | 648 | 1.66 | 19.3 | 1.61 | 0.970 | 10.7 | Comparative Steel |
| 3-2 | 649 | 1.66 | 19.3 | 1.60 | 0.964 | 10.8 | Comparative Steel |
| 3-3 | 648 | 1.66 | 18.3 | 1.65 | 0.994 | 9.6 | Invention Steel |
| 3-4 | 646 | 1.66 | 18.4 | 1.65 | 0.994 | 9.7 | Invention Steel |
| 3-5 | 595 | 1.66 | 17.5 | 1.65 | 0.994 | 10.6 | Comparative Steel |
| 3-6 | 647 | 1.66 | 19.8 | 1.61 | 0.970 | 10.9 | Comparative Steel |
| 3-7 | 648 | 1.66 | 19.7 | 1.61 | 0.970 | 11.1 | Comparative Steel |
| 3-8 | 646 | 1.66 | 18.5 | 1.65 | 0.994 | 11.1 | Comparative Steel |
| 3-9 | 648 | 1.66 | 18.4 | 1.65 | 0.994 | 11.1 | Comparative Steel |
| 3-10 | 593 | 1.66 | 17.6 | 1.65 | 0.994 | 11.2 | Comparative Steel |
| 3-11 | 645 | 1.66 | 19.9 | 1.59 | 0.958 | 10.6 | Comparative Steel |
| 3-12 | 646 | 1.66 | 18.3 | 1.65 | 0.994 | 9.8 | Invention Steel |
| 3-13 | 645 | 1.66 | 20.2 | 1.60 | 0.964 | 11.1 | Comparative Steel |
| 3-14 | 645 | 1.65 | 18.2 | 1.64 | 0.994 | 11.2 | Comparative Steel |

[Evaluation Test]

With respect to the non-oriented electrical steel sheets after the final annealing, the area ratios (%) of crystal structures A, the average crystal grain sizes (μm) of crystal structures B, the Vickers hardnesses HvA of the crystal structures A, the Vickers hardnesses HvB of the crystal structures B, tensile strengths TS (MPa), and the magnetic flux densities BA and the iron losses $W_{10/400}$ before the additional heat treatment were obtained by the same method as that of Example 1.

Moreover, magnetic characteristics (magnetic flux densities BB and iron losses $W_{10/400}$) of the non-oriented electrical steel sheets after the additional heat treatment were obtained by the same method as Example 1.

[Test Result]

The obtained results, are shown in Table 4.

The chemical compositions of non-oriented electrical steel sheets of Test Nos. 3-3, 3-4 and 3-12 were appropriate, and the manufacturing conditions were also appropriate. As a result, the area ratios of the crystal structures A were 1 to 30%, and the average grain sizes of the crystal structures B were 25 μm or less. Moreover, the ratios (HvA/HvB) of the hardness HvA of each crystal structure A to the hardnesses HvB of each crystal structure B was 1.000 or less. For that reason, tensile strengths TS were 600 MPa or more and excellent strength was exhibited.

Moreover, magnetic flux densities BB after the additional heat treatment were 1.65 T or more, iron losses $W_{10/400}$ were 10.0 W/kg or less, and excellent magnetic characteristics were obtained. Moreover, the ratio (BB/BA) of each magnetic flux density BB after the additional heat treatment to each magnetic flux density BA during the additional heat treatment was 0.980 or more, and a decrease in magnetic flux density was limited even after the additional heat treatment.

Meanwhile, in Test Nos, 3-1, 3-2, and 3-11, chemical compositions were appropriate, but average cooling rates $CR_{700-500}$ were less than 50° C./sec. For that reason, hardness ratios HvA/HvB exceeded 1.000. As a result, magnetic flux densities BB after the additional heat treatment were as low as less than 1.65 T, and BB/BA also became less than 0.980. Additionally, iron losses $W_{10/400}$ decrease only to a value of more than 10.0 W/kg, and the effects of the additional heat treatment were not sufficiently exhibited.

In Test No. 3-5, maximum attainment temperature in the final annealing exceeded 800° C. For that reason, the area ratio of the crystal structure A became less than 1%, and tensile strength TS, was as low as less than 600 MPa.

The S contents were high in Test Nos. 3-6 to 3-10, 3-13, and 3-14. For that reason, the iron losses $W_{10/400}$ exceeded 10.0 W/kg.

Moreover, in Test Nos. 3-6, 3-7, and 3-13, average cooling rates $CR_{700-500}$ were less than 50° C./sec. For that reason, hardness ratios HvA/HvB exceeded 1.000. As a result, magnetic flux densities BB after the additional heat treatment were as low as less than 1.65 T, and BB/BA also became less than 0.980.

EXAMPLE 4

Slabs of steel type A in Table 1 were prepared. In Test Nos. 4-1 to 4-5, hot-rolled steel sheets were manufactured by heating the prepared slabs at a slab heating temperature of 1180° C. and performing the hot rolling. On the other hand, in Test Nos. 4-6 to 4-9, slab heating temperatures were 1240° C. and exceeded 1200° C.

In any test numbers, finish temperatures FT during the hot rolling were 890 to 920° C., and coiling temperatures CT were 590 to 630° C.

The hot-rolled sheet annealing was performed on the manufactured hot-rolled steel sheets. In the hot-rolled sheet annealing, average heating speeds $HR_{750-850}$ in a temperature range of 750 to 850° C. were 60° C./sec in Test Nos. 4-1 to 4-5 and was 30° C./sec in Test Nos. 4-6 to 4-9. Moreover, in any test numbers, maximum attainment temperatures were 900° C., and retention times were 2 minutes.

The hot-rolled steel sheets after the hot-rolled sheet annealing was performed were pickled. Intermediate steel sheets (cold-rolled steel sheets) having a sheet thickness of 0.25 mm were manufactured by performing the cold rolling at a rolling reduction of 87% on the hot-rolled steel sheets after the pickling.

The final annealing was performed on the intermediate steel sheets. In the final annealing, maximum attainment temperatures of other test numbers excluding Test No. 4-1 was 750° C., and maximum attainment temperature was 840° only in Test No. 4-1. Additionally, retention times of any test numbers were 30 seconds. Additionally an average cooling rate $CR_{700-500}$ in a temperature range of 700 to 500° C. were 100° C./sec in Test Nos. 4-1 to 4-5 and was 40° C./sec in Test Nos. 4-6 to 4-9.

The non-oriented electrical steel sheets after the final annealing were coated with well-known insulating films containing phosphoric-acid-based inorganic substance and epoxy-based organic substance. The non-oriented electrical steel sheets of the respective test numbers were manufactured by the above step. As a result of check analysis the non-oriented electrical steel sheets after the final annealing, the chemical compositions were as shown in Table 1.

[Evaluation Test]

With respect to the non-oriented electrical steel sheets after the final annealing, area ratios (%) of crystal structures A, average crystal grain sizes (μm) of crystal structures B, Vickers hardnesses HvA of the crystal structures A, the Vickers hardnesses HvB of the crystal structures B, tensile strengths TS (MPa), and magnetic flux densities BA and iron losses $W_{10/400}$ before the additional heat treatment were, obtained by the same method as that of Example 1.

[Magnetic Characteristic Evaluation Test in Non-oriented Electrical Steel Sheet After Additional Heat Treatment]

Epstein test pieces, which are cut out in the rolling direction (L direction) and an orthogonal-to-rolling direction (C direction), respectively, from the non-oriented electrical steel sheets according to JIS C 2550-1 (2011) of the respective test numbers, were prepared. The additional heat treatment was performed on the Epstein test pieces in a nitrogen atmosphere, at heating speeds (° C./hr), maximum attainment temperatures (° C.), and retention times (hours) at 800° C., which are shown in Table 5.

TABLE 5

| | | AfterFinal annealing | | | | | | | |
|---|---|---|---|---|---|---|---|---|---|
| Test Nos. | Steel Type | Crystal Structure A Area Ratio (%) | Crystal Structure B Average Grain Size (μm) | HvA | HvB | HvA/HvB | TS (MPa) | Magnetic Flux Density BA (T) | $W_{10/400}$ (W/kg) |
| 4-1 | A | 0 | 26 | — | 235 | — | 576 | 1.67 | 17.6 |
| 4-2 | A | 10 | 14 | 234 | 238 | 0.983 | 645 | 1.67 | 18.7 |
| 4-3 | | | | | | | | | |
| 4-4 | | | | | | | | | |
| 4-5 | | | | | | | | | |
| 4-6 | A | 10 | 13 | 242 | 239 | 1.013 | 648 | 1.67 | 18.8 |
| 4-7 | | | | | | | | | |
| 4-8 | | | | | | | | | |
| 4-9 | | | | | | | | | |

TABLE 5-continued

| Test Nos. | Additional Treatment Condition: Heating speed (° C./hr) | Maximum Attainment Temperature (° C.) | Retention Time at 800° C. (hr) | After Additional Heat Treatment: Magnetic Flux Density BB (T) | BB/BA | $W_{10/400}$ (W/kg) | Remarks |
|---|---|---|---|---|---|---|---|
| 4-1 | 100 | 800 | 2 | 1.66 | 0.994 | 10.1 | Comparative Steel |
| 4-2 | 50 | 800 | 2 | 1.65 | 0.988 | 9.2 | Invention Steel |
| 4-3 | 100 | 800 | 2 | 1.68 | 1.006 | 9.2 | |
| 4-4 | 500 | 800 | 2 | 1.67 | 1.000 | 9.2 | |
| 4-5 | 36000 | 800 | 2 | 1.66 | 0.994 | 9.4 | |
| 4-6 | 50 | 800 | 2 | 1.62 | 0.970 | 9.3 | Comparative Steel |
| 4-7 | 100 | 800 | 2 | 1.63 | 0.976 | 9.2 | |
| 4-8 | 500 | 800 | 2 | 1.63 | 0.976 | 9.3 | |
| 4-9 | 36000 | 800 | 2 | 1.66 | 0.994 | 9.4 | |

Magnetic characteristics (magnetic flux density $B_{50}$ and iron loss $W_{10/400}$ were obtained by performing electrical steel strip test methods according to JIS C 2550-1 (2011) and 2550-3 (2011) on the Epstein test pieces after the additional heat treatment. The magnetic flux density $B_{50}$ obtained by the main test after the additional heat treatment was defined as magnetic flux density BB(T).

[Test Result]

The obtained results are shown in Table 5.

Chemical compositions of non-oriented electrical steel sheets as being final-annealed that are materials for Test Nos. 4-2 to 4-5 were appropriate, and manufacturing conditions were also appropriate. As a result, the area ratios of the crystal structures A were 1 to 30%, and the average grain sizes of the crystal structures B were 25 μm or less. Moreover, the ratios (HvA/HvB) of the hardness HvA of each crystal structure A to the hardnesses HvB of each crystal structure B was 1.000 or less. Tensile strengths TS were 600 MPa or more and excellent strength was exhibited.

Moreover, Test Nos. 4-3 to 4-5 in which the above materials were subjected to the additional heat treatment under appropriate conditions showed that magnetic flux densities after the additional heat treatment were comparable to magnetic flux densities before the additional heat treatment, or had improved characteristics. Although Test No. 4-2 had a slower heating speed of the additional heat treatment and a decreased magnetic flux density after the additional heat treatment than the other Test Nos. 4-3 to 4-5, BB/BA was 0.980 or more, and a decrease in magnetic flux density can be sufficiently limited.

On the other hand, in the non-oriented electrical steel sheets that were materials of Test Nos. 4-6 to 4-9 and were as being final-annealed in which manufacturing conditions were not appropriate, in a case where the additional heat treatment was performed at a slow heating speed, a decrease in magnetic flux density after the additional heat treatment was remarkable, and BB/BA was less than 0.980. It can be seen from the above results that, in the above materials, the heating speed in the additional heat treatment needs to be as rapid heating speed as the continuous annealing in order to suppress a decrease in magnetic flux density, and the decrease in magnetic flux density is not avoided in the stress relief annealing that is practically performed. Additionally in all the materials, iron losses decreased to a level commensurate to grain growth and strain removal by the additional heat treatment.

In the above, the embodiment of the invention has been described. However, the above-described embodiment is merely examples for carrying out the invention. In addition, the present disclosure is, not limited to the above-described embodiment, and can be variously modified and carried out without departing from the scope of the invention.

INDUSTRIAL APPLICABILITY

According to the invention, the non-oriented electrical steel sheet having high strength and having excellent magnetic characteristics even after the additional heat treatment, and the method for manufacturing the non-oriented electrical steel sheet are obtained. The non-oriented electrical steel sheet of the invention can be widely applied to applications requiring high strength and excellent magnetic characteristics. Particularly, the invention is suitable for applications of components that have drive motors of turbine generators, electric automobiles, and hybrid cars, and rotors of high-speed rotating machines, such as motors for machine tools, as typical examples, and have a large stress applied thereto. Additionally, the invention is suitable for applications in which rotor materials and stator materials of high-speed rotation motors are made of the same steel sheets.

What is claimed is:

1. A non-oriented electrical steel sheet comprising, as a chemical composition, by mass %:

C: 0.0100% or less;

Si: more than 3.0% and 5.0% or less;

Mn: 0.1 to 3.0%;

P: 0.20% or less;

S: 0.0018% or less;

N: 0.0040% or less;

Al: 0 to 0.9%;

one or more selected from the group consisting of Sn and Sb: 0 to 0.100%;

Cr: 0 to 5.0%;

Ni: 0 to 5.0%;

Cu: 0 to 5.0%;

Ca: 0 to 0.01%;

rare earth elements (REM): 0 to 0.010%; and a remainder including Fe and impurities, wherein an area ratio of a crystal structure A composed of crystal grains having a grain size of 100 μm or greater in a cross section parallel to a rolled surface of the non-oriented electrical steel sheet is 1 to 30%, wherein an average grain size of a crystal structure B that is a crystal structure other than the crystal structure A is 25 μm or less, and wherein a Vickers hardness HvA of the crystal structure A and a Vickers hardness HvB of the crystal structure B satisfy Expression (1).

$$HvA/HvB \leq 1.000 \quad (1)$$

2. The non-oriented electrical steel sheet according, to claim 1, wherein the chemical composition contains one or more selected from the group consisting of the group consisting of:

Al: 0.0001 to 0.9%;

one or more selected from the group consisting of Sn and Sb: 0.005 to 0.100%;

Cr: 0.5 to 5.0%;

Ni: 0.05 to 5.0%;

Cu: 0.5 to 5.0%;

Ca: 0.0010 to 0.0100%; and rare earth elements (REM): 0.0020 to 0.0100% or less.

3. A method for manufacturing the non-oriented electrical steel sheet according to claim 1, comprising:

performing a hot rolling to manufacture a hot-rolled steel sheet after a slab having the chemical composition according to claim 1 is heated at 1000 to 1200° C.;

performing a hot-rolled sheet annealing with an average heating speed at 750 to 850° C. being 50° C./sec or higher and a maximum attainment temperature being 900 to 1150° C., on the hot-rolled steel sheet;

performing a cold rolling or warm rolling at a rolling reduction of 83% or more on the hot-rolled steel sheet after the hot-rolled sheet annealing, to manufacture an intermediate steel sheet; and performing a final annealing with a maximum attainment temperature being 700 to 800° C. and an average cooling rate in a temperature range of 700 to 500° C. being 50° C./sec or higher, on the intermediate steel sheet; thereby producing the non-oriented electrical steel sheet of claim 1.

* * * * *